US011304477B2

(12) United States Patent
Beers et al.

(10) Patent No.: US 11,304,477 B2
(45) Date of Patent: Apr. 19, 2022

(54) FOOTWEAR HEEL SPRING DEVICE

(71) Applicant: NIKE, Inc., Beaverton, OR (US)

(72) Inventors: Tiffany A. Beers, Portland, OR (US); John T. Dimoff, Portland, OR (US); Wade Flanagan, Portland, OR (US); Austin Orand, Portland, OR (US); Gerald Sullivan, Portland, OR (US); George A. Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 39 days.

(21) Appl. No.: 16/933,118

(22) Filed: Jul. 20, 2020

(65) Prior Publication Data

US 2020/0345105 A1 Nov. 5, 2020

Related U.S. Application Data

(63) Continuation of application No. 16/008,797, filed on Jun. 14, 2018, now Pat. No. 1,074,616, which is a continuation-in-part of application No. 15/793,008, filed on Oct. 25, 2017, now Pat. No. 10,568,385.

(60) Provisional application No. 62/413,062, filed on Oct. 26, 2016, provisional application No. 62/532,449, filed on Jul. 14, 2017.

(51) Int. Cl.

| | |
|---|---|
| ***A43B 23/08*** | (2006.01) |
| ***A43B 21/26*** | (2006.01) |
| ***A43B 21/32*** | (2006.01) |
| ***A43B 11/00*** | (2006.01) |
| ***A43B 3/24*** | (2006.01) |

(52) U.S. Cl.

CPC ..... *A43B 21/26* (2013.01); *A43B 3/248* (2013.01); *A43B 11/00* (2013.01); *A43B 21/32* (2013.01); *A43B 23/088* (2013.01)

(58) Field of Classification Search

CPC ..... A43B 23/08; A43B 23/088; A43B 23/17; A43B 11/00; A43B 11/02; A43B 13/145; A43B 13/143

USPC ..... 36/25 R, 88, 92, 68, 69, 27, 28

See application file for complete search history.

(56) References Cited

U.S. PATENT DOCUMENTS

| | | | |
|---|---|---|---|
| 465,189 | A | 12/1891 | Morison |
| 882,109 | A | 3/1908 | Harris |
| 1,090,106 | A | 3/1914 | Montine |

(Continued)

FOREIGN PATENT DOCUMENTS

| | | | |
|---|---|---|---|
| CN | 102365035 | A | 2/2012 |
| CN | 102770039 | A | 11/2012 |

(Continued)

*Primary Examiner* — Marie D Bays
(74) *Attorney, Agent, or Firm* — Quinn IP Law

(57) ABSTRACT

A device configured to surround a portion of a foot-receiving cavity at a heel region of an article of footwear includes a control bar having a center segment, a medial side arm extending from the center segment, and a lateral side arm spaced from the medial side arm and extending from the center segment. The device may include an extension extending toward the control bar. At least a portion of the control bar may be elastically deformable under an applied force depressing the control bar toward the extension, and the extension may limit movement of the control bar. The control bar may be adapted to return to an unloaded position upon removal of the applied force.

20 Claims, 22 Drawing Sheets

(56) References Cited

U.S. PATENT DOCUMENTS

| | | | | | |
|---|---|---|---|---|---|
| 1,686,175 | A * | 10/1928 | Read | A43B 11/00 | 36/58.5 |
| 1,793,380 | A | 2/1931 | Stone | | |
| RE21,654 | E | 12/1940 | Disch | | |
| 2,447,590 | A | 8/1948 | Meltzer | | |
| 2,736,110 | A * | 2/1956 | Hardimon | A43B 11/00 | 36/58.5 |
| 2,920,402 | A * | 1/1960 | Minera | A43B 3/102 | 36/58.5 |
| 3,283,423 | A | 11/1966 | Schovee | | |
| 4,402,146 | A | 9/1983 | Parracho et al. | | |
| 4,459,765 | A | 7/1984 | Power | | |
| 4,566,206 | A | 1/1986 | Weber | | |
| 4,625,435 | A | 12/1986 | Ueda | | |
| 5,127,170 | A * | 7/1992 | Messina | A43B 3/102 | 36/105 |
| 5,787,608 | A | 8/1998 | Greenawalt | | |
| 6,000,148 | A * | 12/1999 | Cretinon | A43B 5/00 | 36/69 |
| 6,497,058 | B2 | 12/2002 | Dietrich et al. | | |
| 6,557,271 | B1 * | 5/2003 | Weaver, III | A43B 3/0063 | 36/144 |
| 7,082,702 | B2 | 8/2006 | Cretinon | | |
| 8,020,317 | B1 * | 9/2011 | Sokolowski | A43B 23/17 | 36/69 |
| 8,225,535 | B2 * | 7/2012 | Dillenbeck | A43B 3/248 | 36/100 |
| 9,433,256 | B2 * | 9/2016 | Callahan | A43B 3/0057 | |
| 10,568,385 | B2 * | 2/2020 | Beers | A43B 11/00 | |
| 10,743,616 | B2 * | 8/2020 | Beers | A43B 11/00 | |
| 10,905,192 | B1 | 2/2021 | Cheney | | |
| 2002/0112376 | A1 | 8/2002 | Tomat | | |
| 2005/0193594 | A1 | 9/2005 | Murphy | | |
| 2009/0113757 | A1 | 5/2009 | Banik | | |
| 2012/0304491 | A1 | 12/2012 | Kimura et al. | | |
| 2012/0317839 | A1 * | 12/2012 | Pratt | A43B 11/00 | 36/102 |
| 2013/0185959 | A1 * | 7/2013 | Coleman | A43B 11/00 | 36/107 |
| 2014/0202044 | A1 | 7/2014 | Adami et al. | | |
| 2014/0305005 | A1 * | 10/2014 | Yeh | A43B 7/143 | 36/69 |
| 2016/0120259 | A1 | 5/2016 | Benetti | | |
| 2016/0374427 | A1 * | 12/2016 | Zahabian | A43B 3/24 | 36/102 |
| 2018/0110288 | A1 * | 4/2018 | Hatfield | A43B 11/00 | |
| 2019/0297999 | A1 | 10/2019 | Nakaya et al. | | |

FOREIGN PATENT DOCUMENTS

| | | | |
|---|---|---|---|
| CN | 203828164 | U | 9/2014 |
| CN | 203986373 | U | 12/2014 |
| CN | 204519530 | U | 8/2015 |
| CN | 205658453 | U | 10/2016 |
| CN | 107874384 | A | 4/2018 |
| EP | 0149362 | A2 | 7/1985 |
| EP | 2082658 | A1 | 7/2009 |
| EP | 2204102 | A1 | 7/2010 |
| JP | 2000139502 | A | 5/2000 |
| JP | 2005532115 | A | 10/2005 |
| JP | 2012061046 | A | 3/2012 |
| KR | 101841085 | B1 | 3/2018 |
| TW | 201215342 | A | 4/2012 |
| WO | 2008152414 | A1 | 12/2008 |
| WO | 2016002412 | A1 | 1/2016 |
| WO | 2017184943 | A1 | 10/2017 |

* cited by examiner

FOOTWEAR HEEL SPRING DEVICE

CROSS-REFERENCE TO RELATED APPLICATIONS

This application is a continuation of U.S. application Ser. No. 16/008,797, which is a continuation-in-part of and claims the benefit of priority to U.S. application Ser. No. 15/793,008, filed Oct. 25, 2017, which claims the benefit of priority to U.S. Provisional Application No. 62/413,062, filed Oct. 26, 2016, and which also claims the benefit of priority to U.S. Provisional Application No. 62/532,449, filed Jul. 14, 2017, and all of which are incorporated by reference in their entireties.

TECHNICAL FIELD

The present teachings generally include a heel spring device for an article of footwear.

BACKGROUND

Traditionally, placing footwear on a foot often requires the use of one or both hands to stretch the ankle opening of a footwear upper, and hold the rear portion during foot insertion, especially in the case of a relatively soft upper and/or an upper that does not have a heel counter.

DESCRIPTION

Figure 1:
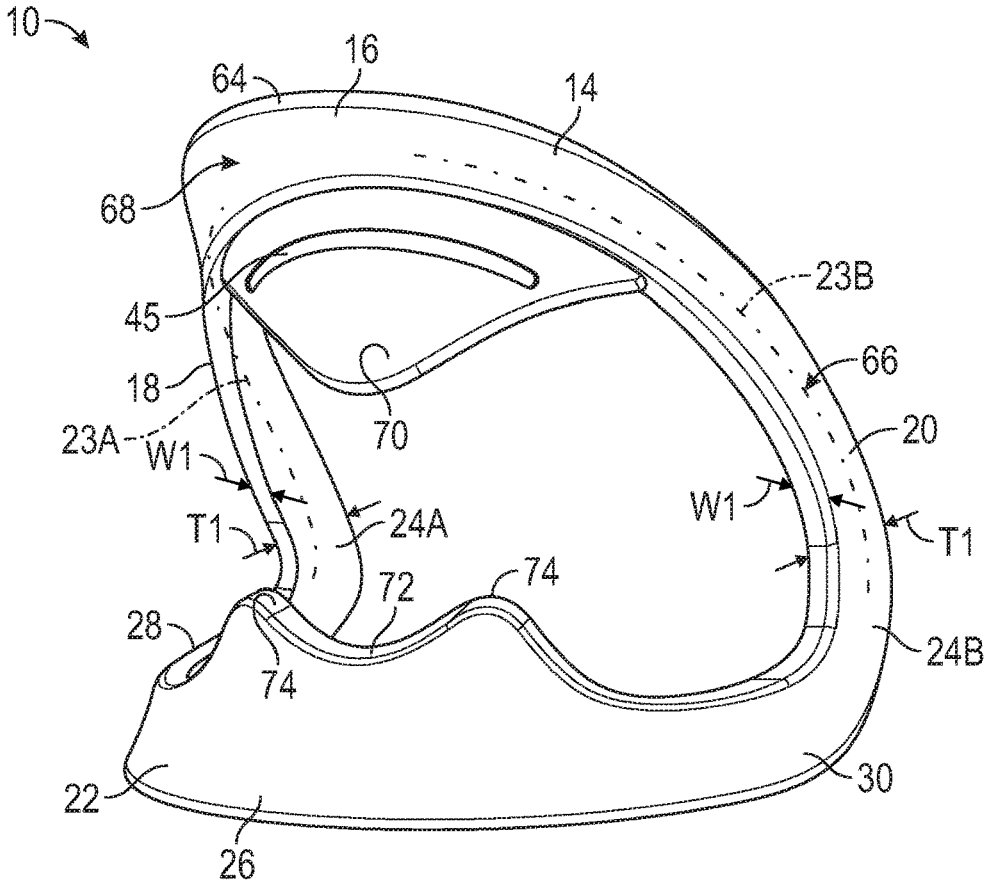
FIG. 1 is a schematic illustration in perspective view of a heel spring device for an article of footwear in an unloaded position.

Devices for easing foot entry into an article of footwear are disclosed herein. Each of the devices may enable hands-free foot entry, such as by loading the device with the foot to access a foot-receiving cavity from a rearward position, and sliding the foot forward and downward into the foot-receiving cavity.

Within the scope of the present teachings, an article of footwear may comprise an upper defining a foot-receiving cavity with an ankle opening. A sole structure may be secured to and may underlie the upper. A heel spring device may be connected to a heel region of the upper. The heel spring device may include a control bar having a center segment connected to the upper rearward of the ankle opening, a medial side arm extending downwardly and forwardly from the center segment at a medial side of the upper, and a lateral side arm extending downwardly and forwardly from the center segment at a lateral side of the upper. The center segment, medial side arm, and lateral side arm may be portions of an integral, one-piece component, or may be separate components attached to one another. The heel spring device may further include an extension disposed in a back portion of the article of footwear and extending upwardly toward the control bar. At least a portion of the control bar may be elastically deformable under an applied downward force depressing the control bar toward the extension. The extension may limit downward movement of the control bar. The control bar and the upper may return to an unloaded position upon removal of the applied load. The upper may move with the center segment and may deform such that the ankle opening may be closer to the sole structure when the control bar is depressed than when the applied load is removed.

In one or more embodiments of the article of footwear, ends of the medial side arm and the lateral side arm opposite the center segment may be anchored, such as to the sole structure. In such embodiments, for example, the extension may be secured to the upper or to the sole structure in the back portion of the article of footwear, such as in a rear-facing portion of the heel region.

In one or more embodiments of the article of footwear, the extension may be centrally disposed on the back portion of the article of footwear and the heel region of the upper may deform towards the foot-receiving cavity when the control bar is depressed.

In one or more embodiments of the article of footwear, the center segment of the control bar may include an aperture, and the article of footwear may further comprise a tab extending from the heel region of the upper through the aperture and secured to the heel region of the upper adjacent to the control bar to connect the upper to the control bar.

In one or more embodiments of the article of footwear, the upper has a first thickness at a first location between the control bar and the extension and a second thickness at a second location between the first location and the extension. The second thickness may be less than the first thickness. This may encourage folding of the upper at the thinner, second location when the control bar is under the applied load.

In one or more embodiments, the article of footwear may further comprise a base having a medial base arm connected to the medial arm of the control bar, a lateral base arm connected to the lateral arm of the control bar, and a center segment connecting the medial base arm to the lateral base arm. The extension may be disposed on the center segment of the base and may extend away from the medial base arm and the lateral base arm.

In one or more embodiments, the extension may have a beveled outer surface with a concave upper bevel extending forwardly from a rearmost extent of the extension, and a lower bevel that slopes downwardly and forwardly from the rearmost extent of the extension. The sole structure may slope downwardly and forwardly from the lower bevel.

An upper surface of the center segment of the control bar may slope forwardly and downwardly into the foot-receiving cavity. In one or more embodiments, at either or both of the medial side and the lateral side of the control bar, the upper surface of the center segment extends along a ledge projecting forwardly above a descending portion of a corresponding one of the medial side arm and lateral side arm. The ledge may be referred to as a raised ledge and may be adapted to be depressed by a user's foot. The ledge may help wearers who have limited dexterity or accuracy of foot placement as it may more easily enable depression of the control bar to occur even in the event that the foot is not precisely centered over the control bar.

In one or more embodiments, the footwear upper may be characterized by the absence of a rigid heel counter in the heel region. For example, in embodiments in which the device includes a base, there may be an absence of a rigid heel counter between the control bar and the base aft of a junction between the control bar and the base.

Within the scope of the present teachings, a device configured to surround a portion of a foot-receiving cavity at a heel region of an article of footwear comprises a control bar having a center segment, a medial side arm extending from the center segment, and a lateral side arm spaced from the medial side arm and extending from the center segment. The device may comprise an extension extending toward the control bar. At least a portion of the control bar may be elastically deformable under an applied force depressing the control bar toward the extension, and the extension may limit movement of the control bar. The control bar may be adapted to return to an unloaded position upon removal of the applied force.

In one or more embodiments of the device, the extension may have a rear protrusion that has a beveled outer surface with a concave upper bevel extending forwardly from a rearmost extent of the rear protrusion, and with a lower bevel that slopes downwardly and forwardly from the rearmost extent of the rear protrusion.

In one or more embodiments of the device, the device further comprises a base connected to both the medial side arm and the lateral side arm, and the extension may extend from the base. The medial side arm and the lateral side arm may extend downwardly and forwardly from the center segment of the control bar to define an acute angle with the base when in the unloaded position.

In one or more embodiments of the device, the medial side arm and the lateral side arm may extend downwardly and forwardly from the center segment of the control bar to define an acute angle with the base when in the unloaded position.

In one or more embodiments of the device, the base may have a medial base arm connected to the medial side arm of the control bar, a lateral base arm connected to the lateral side arm of the control bar, and a center segment connecting the medial base arm to the lateral base arm, and the extension may be a rounded protrusion extending upwardly from the center segment of the base.

In one or more embodiments of the device, the center segment of the base may have a rear protrusion extending away from the medial base arm and the lateral base arm.

In one or more embodiments of the device, the rear protrusion may have a beveled outer surface with a concave upper bevel extending forwardly from a rearmost extent of the rear protrusion, and a lower bevel that slopes downwardly and forwardly from the rearmost extent of the rear protrusion.

In one or more embodiments of the device, an upper surface of the center segment of the control bar slopes forwardly and downwardly. In one or more embodiments of the device, the center segment of the control arm may have an aperture extending through the center segment. The aperture may be configured as a curved slot. In one or more embodiments of the device, at either or both of the medial side and the lateral side of the control bar, an upper surface of the center segment may extend along a ledge projecting forwardly above a descending portion of a corresponding one of the medial side arm and lateral side arm. The ledge may be referred to as a raised ledge, and may be adapted to be depressed by a user's foot. At least a portion of the device may be a relatively low coefficient of friction (e.g., relative to the material or materials of the upper). For example, in one or more embodiments of the device, at least a portion of the device may comprise a polyether block amide.

The device may store potential energy, such as elastic energy and/or spring energy, which returns the control bar to the unstressed position upon removal of the applied load. As used herein, elastic bending may also be referred to as resilient bending, and entails resilient deformation or elastic deformation. For example, a foot partially inserted into the foot-receiving cavity of the upper can press down on the control bar, and the heel region of the foot can then slip into the foot-receiving cavity to complete foot entry without requiring the use of a hand or of any tool to adjust the upper. In one example, the extension limits the amount of deformation of the control bar, thereby preventing plastic deformation. Because plastic deformation could cause rupture of the device due to failure of the material of the device over time, the extension may prolong the useful life of the device.

In one or more embodiments of the device, an upper surface of the center segment of the control arm may slope forwardly and downwardly. This ramped surface may help direct the foot downward and forward into the foot-receiving cavity during application of the downward force on the control bar. At least a portion of the device may comprise a material having certain properties, such as a relatively low coefficient of friction to encourage the foot to slide downward and forward in this manner. For example, at least a portion of the device may include a material with a lower coefficient of friction than the material or materials of the upper. For example, at least a portion of the device may include a coating having these properties. In one example, at least a portion of the device may comprise a polyether block amide. If at least a portion of the device comprises a material with a relatively low coefficient of friction, this may ease foot entry whether the foot is bare or a sock is disposed on the foot, as both bare skin or any of various sock materials may slide with greater ease downward and forward into the foot-receiving cavity when sliding against the at least a portion of the control bar that includes a material with a relatively low coefficient of friction.

In one or more embodiments of the device, the device, including the control bar and the base, if any, may be a single, unitary, one-piece component. In one or more embodiments of the device, the first side arm and the second side arm bow apart from one another when the control bar is in the loaded position. With a footwear upper attached to the side arms, a foot-receiving cavity of the footwear upper is opened wider when the side arms bow apart, thus further easing foot entry into the foot-receiving cavity.

In one or more embodiments of the device, the first side arm and the second side arm may each twist outwardly along their respective longitudinal axis from the base to the center segment of the control bar. The outward twist may help to encourage the down and back movement of the center segment during loading by the foot.

In one or more embodiments of the device, the first side arm and the second side arm may be asymmetrical with respect to (i.e., about) a longitudinal axis of the article of footwear extending between the first side arm and the second side arm. For example, the first side arm may be a medial side arm and the second side arm may be a lateral side arm. The medial side arm may be shorter than the lateral side arm, may have a greater lateral curvature than the lateral side arm, or both, similar to the shape of a typical heel region of a foot.

In one or more embodiments of the device, the base may have an inwardly-extending flange. For example, the flange may be seated in a recess of a sole structure and secured to the foot-receiving surface of the sole structure in a heel region of the sole structure.

In one or more embodiments in which the device includes a base, the base may be a continuous base that extends from the medial side arm to the lateral side arm of the control bar. The base may be referred to as continuous if it is without breaks or connections through other components in extending from the first side arm to the second side arm.

Figure 5:
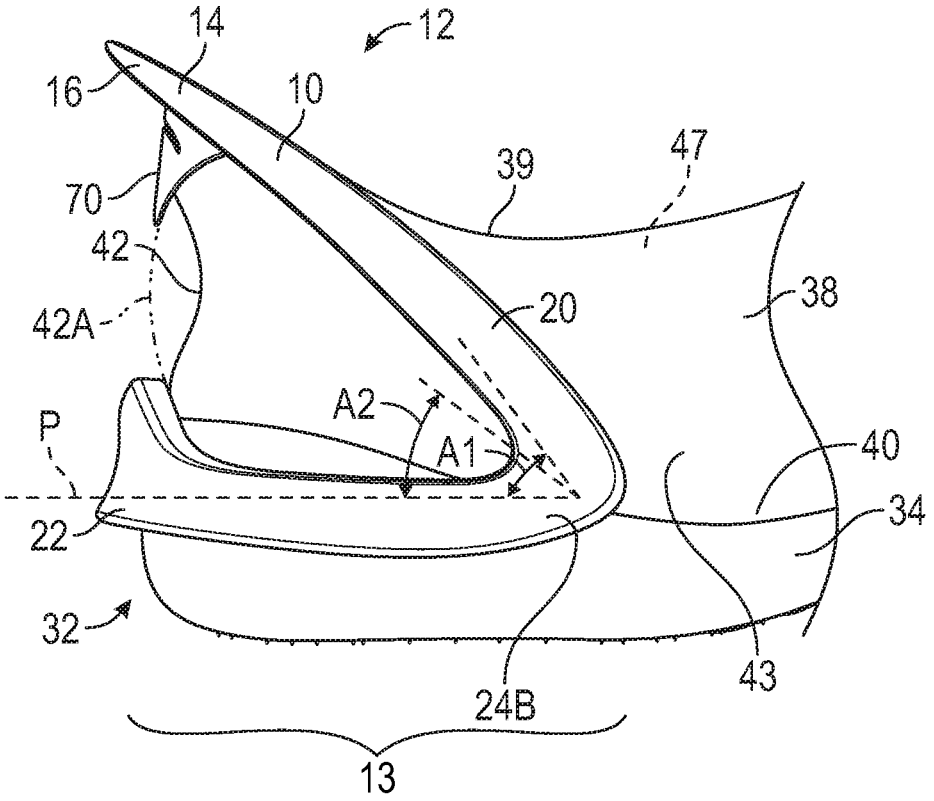
FIG. 5 is a schematic illustration in fragmentary side view of a lateral side of an article of footwear including the device, the footwear upper, and the sole layer of FIG. 4.
Figure 6:
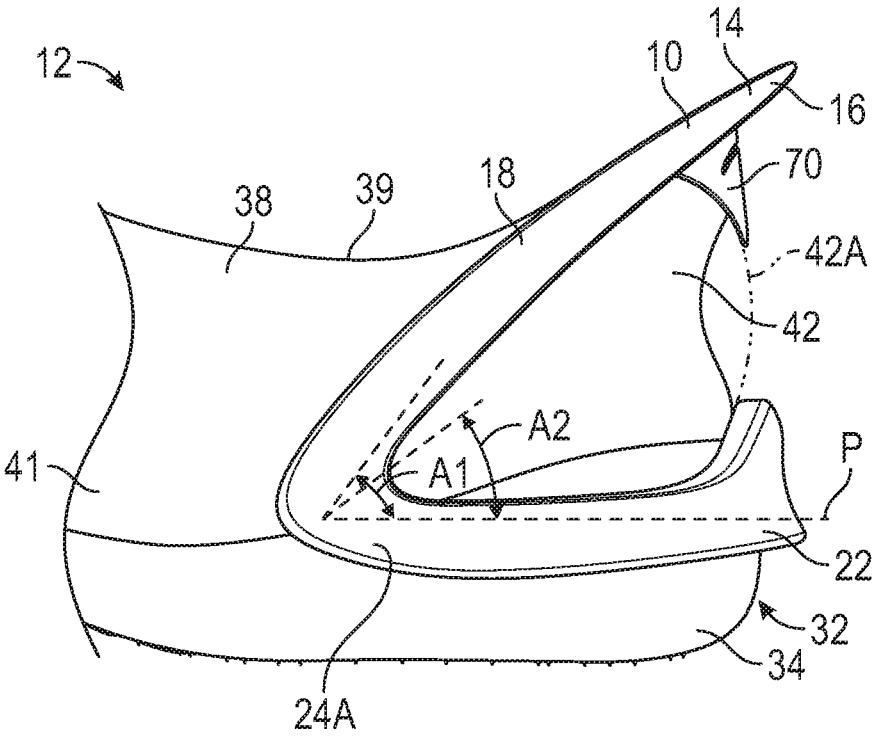
FIG. 6 is a schematic illustration in fragmentary side view of a medial side of the article of footwear of FIG. 5.

Referring to the drawings, wherein like reference numbers refer to like components, FIG. 1 shows a device 10 for easing foot entry into an article of footwear 12 shown in FIGS. 5 and 6. The footwear herein is depicted as leisure shoes and athletic shoes, but the present teachings also include an article of footwear that is a dress shoe, a work shoe, a sandal, a slipper, a boot, or any other category of footwear.

The device 10 is configured to surround a portion of a foot-receiving cavity 47 at a heel region 13 of an article of footwear 12, as shown in FIG. 5. The heel region 13 generally includes portions of the article of footwear 12 corresponding with rear portions of a human foot, including the calcaneus bone, when the human foot is supported on the sole structure 32 in the foot-receiving cavity 47 and is a size corresponding with the article of footwear 12. A forefoot region 15 of the article of footwear 12 (best shown with respect to articles of footwear 3212 and 3512 in FIGS. 17 and 30) generally includes portions of the article of footwear 12 corresponding with the toes and the joints connecting the metatarsals with the phalanges of the human foot (interchangeably referred to herein as the "metatarsal-phalangeal joints" or "MPJ" joints). A midfoot region 17 of the article of footwear 12 (best shown with respect to articles of footwear 3212 and 3312 in FIGS. 17 and 30) is disposed between the heel region 13 and the forefoot region 15 and generally includes portions of the article of footwear 12 corresponding with an arch area of the human foot, including the navicular joint.

The device 10 includes a control bar 14 that has a center segment 16, a first side arm 18 extending downwardly and forwardly from the center segment 16, and a second side arm 20 spaced from the first side arm 18 and also extending downwardly and forwardly from the center segment 16. The first side arm 18 is a medial side arm and the second side arm 20 is a lateral side arm.

Figure 2:
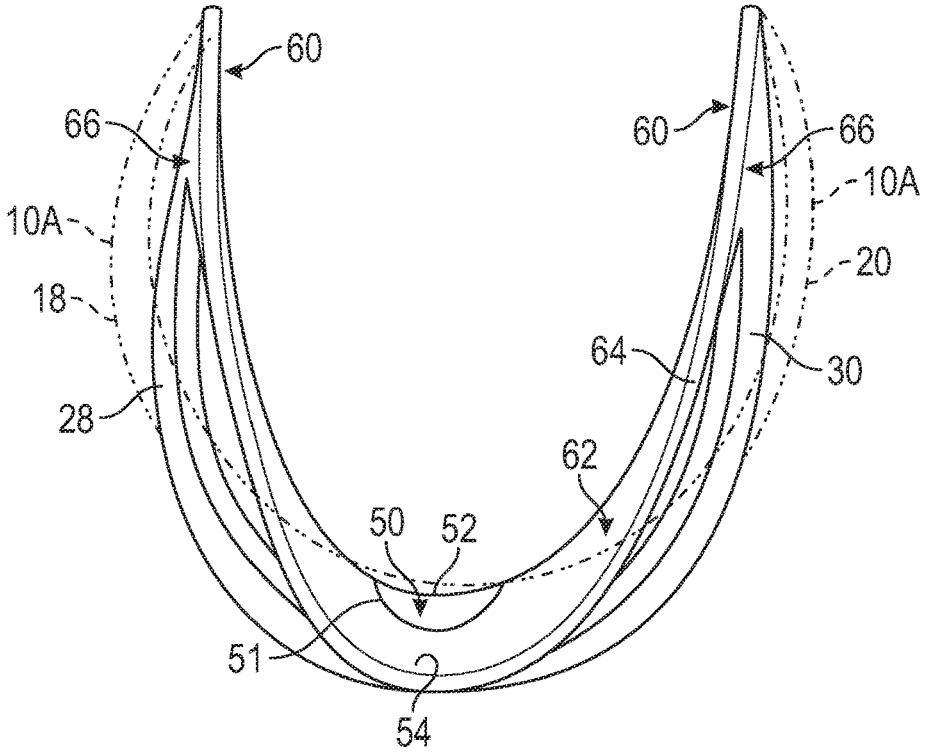
FIG. 2 is a schematic illustration in plan view of the device of FIG. 1 with a loaded position of the device shown in phantom.
Figure 3:
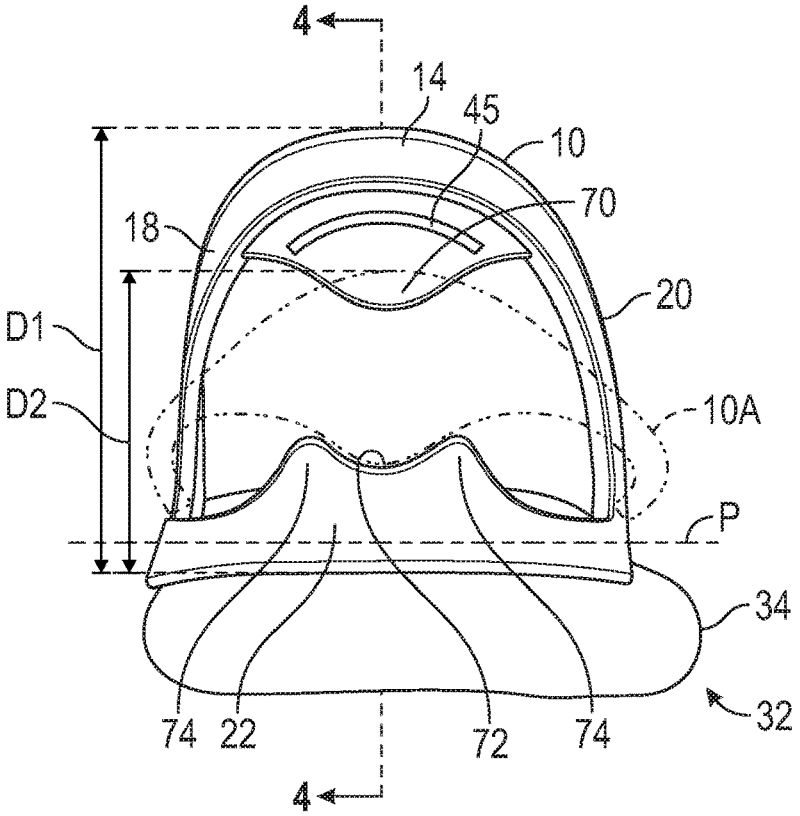
FIG. 3 is a schematic illustration in rear view of the device of FIG. 1 secured to a sole layer, and showing the loaded position in phantom.

The device 10 also includes a base 22 supporting the control bar 14 and connected to the control bar 14 at a resiliently bendable junction 24A, 24B. The base 22 is continuous and extends between and connects to the first side arm 18 and the second side arm 20. The base 22 is continuous, in that it is without breaks or connections through other components in extending from the first side arm 18 to the second side arm 20. The base 22 has a center segment 26, a first base arm 28, and a second base arm 30 all disposed in a common plane. The common plane P is parallel with a horizontal surface when the base 22 of the device 10 rests on a horizontal surface, and is best indicated in FIG. 3 by the phantom line P that represents the plane perpendicular to the page of the drawing. The first base arm 28 is spaced apart from the second base arm 30 and both extend from the center segment 26 of the base 22. As shown in FIG. 2, the base 22 is under the control bar 14, lending stability to the device 10 during depression.

The junction 24A, 24B includes a first joint 24A at which the base 22 and the first side arm 18 connect, and a second joint 24B at which the base 22 and the second side arm 20 connect. The first joint 24A is the connection of the first base arm 28 to the first side arm 18. The second joint 24B is the connection of the second base arm 30 to the second side arm 20.

The control bar 14 has an arced shape from the first joint 24A to the second joint 24B. Similarly, the base 22 has an arced shape from the first joint 24A to the second joint 24B. With this arrangement, the control bar 14 and the base 22 are configured as a full elliptical leaf spring as described herein. The device may be referred to as a heel spring. Additionally, the device 10 is a single, unitary, one-piece component. For example, the device 10 may be injection molded as a single, unitary, one-piece component.

Figure 4:
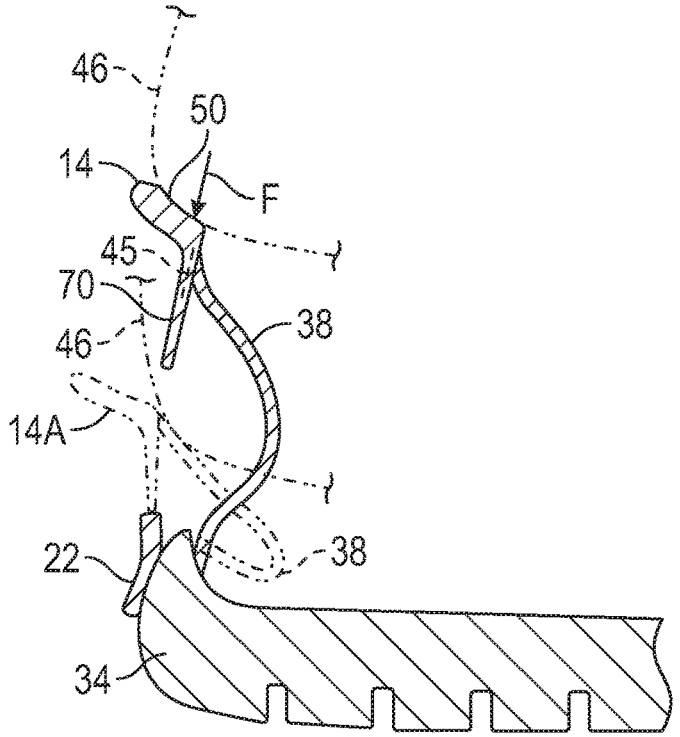
FIG. 4 is a schematic illustration in fragmentary cross-sectional view of the device and sole layer of FIG. 3 taken at lines 4-4 in FIG. 3, and showing a flexible covering of a footwear upper secured to the device.

The control bar 14 is biased to an unloaded position shown in FIGS. 1, 2 and 3. The unloaded position is also referred to herein as an unstressed position. The control bar 14 is internally biased to the unstressed position by its material in its formed state. Stated differently, the material of the control bar 14 is sufficiently rigid that it remains in the unstressed position in its natural state without external loads applied to it, and will return to the unstressed position after elastic bending due to its resiliency. In the unstressed position, the center segment 16 is a first distance D1 from the base 22, as indicated in FIG. 3 by a distance D1 from the top of the center segment 16 to the bottom of the base 22. The unstressed position is the position of the device 10 in a relaxed, unloaded state (i.e., without a vertical force applied to the control bar 14). The control bar 14 can be depressed under an applied force F shown in FIG. 4, representing the force applied by a foot 46 during insertion of the foot 46 into a foot-receiving cavity 47 (see FIGS. 5 and 6) of the article of footwear 12. When loaded in this manner, the control bar 14 elastically bends to a loaded position in which the top of the center segment 16 is a second distance D2 from the base 22. The device 10 is indicated with phantom lines and reference number 10A in FIG. 3 when in the loaded position. The second distance D2 is less than the first distance D1. The difference between the distances D1, D2, is the deflection of the device 10, which may be but is not limited to a deflection of 30 mm. The device 10 is configured so that when it is depressed under the force to the loaded position 10A, it elastically bends at the junction 24A, 24B, storing elastic energy. When the force F is removed, the stored elastic energy returns the control bar 14 to the unstressed position. In FIG. 3, only the device 10 and the sole structure 32 are shown. The upper 38 described herein is removed for clarity in showing the positions of the device 10, 10A.

As shown in FIGS. 5 and 6, the article of footwear 12 includes a sole structure 32 and an upper 38 secured to the sole structure 32. The sole structure 32 includes one or more sole components that may be sole layers 34, such as an outsole, a midsole, or a unitary combination of an outsole and a midsole that may be referred to as a unisole. In FIGS. 5 and 6, the sole layer 34 may be a midsole or a unisole. The sole layer 34 underlies the upper 38. A lower portion 40 of the footwear upper 38 is secured to the sole layer 34, such as by adhesive or otherwise. The base 22 is secured to the sole layer 34 such as by bonding with adhesive, thermal bonding, or otherwise. The sole layer 34 may be formed with slight recesses on the outer surface shaped to allow the base 22 and junction 24A, 24B to partially nest in the recesses, thus being further supported by the sole layer 34.

The flexible footwear upper 38 defines at least a portion of an ankle opening 39. The base 22 underlies the control bar 14 and is secured to the footwear upper 38 with the first side arm 18 secured to a medial side 41 of the footwear upper 38, and the second side arm 20 secured to a lateral side 43 of the footwear upper 38. As best indicated in FIGS. 5 and 6, the base 22 extends around a rearmost portion of the footwear upper 38 from the lateral side 43 to the medial side 41. The center segment 16 of the control bar 14 is secured to the footwear upper 38 rearward of the ankle opening 39. The device 10 may have a thinned portion 45 (best shown in FIG. 3) that enables machine stitching of the upper 38 to the device at the thinned portion 45.

The upper 38 may include a flexible covering 42 (also referred to as a flexible cover layer) for receiving and covering a foot 46 (indicated in FIG. 4) to be supported on the sole layer 34. For example, the flexible covering 42 may be a stretchable fabric, such as a 4-way stretch nylon fabric, lending a light, breathable feel. The article of footwear 12 is characterized by the absence of a rigid heel counter between the control bar 14 and the base 22 aft of the junction 24A, 24B between the control bar 14 and the base 22. The device 10 functions at least in some respects as a heel counter in that it helps to retain a wearer's heel in position atop a heel portion of the sole structure, preventing medial or lateral displacement during use.

Traditionally, slipping a foot into an upper often requires the use of one or both hands to stretch the ankle opening and hold the rear portion during foot insertion, especially in the case of a relatively soft upper and/or an upper that does not have a heel counter secured to the flexible fabric rearward of the ankle opening. The device 10 alleviates these issues, and allows the foot 46 to enter into a foot-receiving cavity 47 formed by the upper 38 without the use of hands or other tools. Only the foot 46 is used to gain entry. Specifically, using the bottom of the foot 46, a force F is applied to press on the control bar 14 as shown in FIG. 4, resiliently bending the device at the joints 24A, 24B moving the control bar 14 from the unstressed position to the loaded position, which is represented by the control bar in position 14A. The upper 38 is attached to the center segment 16, and moves down with the control bar 14. The stored elastic energy due to the bias of the device 10 automatically returns the device 10 to the unstressed position when the foot 46 moves fully into the foot-receiving cavity 47, causing the upper 38 to be automatically pulled up over the back of the foot 46. The position of the stretchable flexible covering 42 prior to inserting the foot is shown in FIG. 5. The flexible covering 42 stretches over the back of the heel of the foot 46 to the position 42A represented in phantom in FIG. 5 when the device 10 returns to the unstressed position.

To further ease entry of the foot 46 into the foot-receiving cavity 47 of the upper 38, the center segment 16 of the control bar 14 has a ramped surface 50 that declines toward an inner periphery 52 of the center segment 16, as indicted in FIGS. 2 and 4. There is a change in slope of the center segment 16 at a transition line 51, between an upper portion 54 of the foot contact surface of the control bar 14 and the ramped surface 50. The ramped surface 50 has a steeper declining slope than the upper portion 54, helping the foot 46 to slide down and inward.

With reference to FIGS. 5 and 6, the first side arm 18 and the second side arm 20 extend at a first acute angle A1 to the common plane P of the base 22 when the control bar 14 is in the unstressed (unloaded) position. The angle A1 may be measured along a longitudinal axis of each side arm. Although shown with the same angle A1, each of the first side arm 18 and the second side arm 20 could have a first acute angle with a different numerical value. The first side arm 18 and the second side arm 20 extend at a second acute angle A2 to the common plane P of the base 22 when the control bar 14 is depressed so that the device 10 is in the loaded position 10A of FIG. 3. The second acute angle A2 may be measured along a longitudinal axis of each side arm. The second acute angle A2 is less than the first acute angle A1. Although shown with the same angle A2, each of the first side arm 18 and the second side arm 20 could have a second acute angle with a different numerical value.

The material of the device 10 is selected to provide the ability to elastically deform by elastic bending as described, and store potential energy, such as elastic energy, that returns the device 10 to the unloaded position (also referred to as the unstressed position). Example materials include plastics (such as thermoplastics), composites, and nylon. Another example material is a polyether block amide such as PEBAX® available from Arkema, Inc. in King of Prussia, Pa. USA. Another example material is a fiberglass reinforced polyamide. An example fiberglass reinforced polyamide is RISLAN® BZM 7 0 TL available from Arkema, Inc. in King of Prussia, Pa. USA. Such a fiberglass reinforced polyamide may have a density of 1.07 grams per cubic centimeter under ISO 1183 test method, an instantaneous hardness of 75 on a Shore D scale under ISO 868 test method, a tensile modulus of 1800 MPa under ISO 527 test method (with samples conditioned 15 days at 23 degrees Celsius with 50% relative humidity), and a flexural modulus of 1500 MPa under ISO 178 test method (with samples conditioned 15 days at 23 degrees Celsius with 50% relative humidity).

Additionally, the relative dimensions and shape of the device 10 at the joints and at the side arms 18, 20 contributes to the spring-biased nature of the device 10, and its ability to elastically deform under a desired amount of loading and return to its original unstressed position. The device 10 may be configured to elastically bend under a maximum force of 160N. For example, with reference to FIG. 1, the first side arm 18 and the second side arm 20 each have a thickness T1 greater than a width W1 at the respective joint 24A, 24B. The thickness T1 is measured in the fore-aft (longitudinal) direction of the footwear 12. The width W1 is measured in the medial-lateral (transverse) direction of the footwear 12. The greater thickness T1 increases the required force to resiliently bend the device 10 to the loaded position.

Additionally, the side arms 18 and 20 are each twisted outwardly along their respective longitudinal axis 23A, 23B from the joints 24A, 24B at the base to the center segment 16. Stated differently, the inward-facing surfaces 60 of the side arms 18, 20 flow continually into a slightly upward-facing surface 62 as a ridge 64 along the side arm 18 or 20 turns from an upward extending ridge to a partially rearward extending ridge at the back of the center segment 16, as best shown in FIG. 2. Similarly, a side surface 66 at the side arms 18 or 20 flows into a slightly downward facing surface 68 under the ridge 64 at the center segment 16, as best shown in FIG. 1. This twist in the side arms 18, 20 helps encourage the down and back movement of the center segment 16 during loading by the foot 46.

The device 10 is also configured to widen as it is moved from the unstressed position to the loaded position. This helps ease insertion of the foot 46 into a flexible upper 38, as the first side arm 18 and the second side arm 20 bow apart from one another when the control bar 14 is depressed, pulling the upper 38 attached to the inward-facing surfaces 60 outward. The bowing of the device 10 in the loaded position 10A is indicated in the plan view of FIG. 2.

While the device 10 is thus configured to ease foot entry with its ability to resiliently deform and store elastic energy, it is also configured to limit the amount of deformation to prevent plastic deformation. More specifically, the control bar 14 has an extension 70 that extends generally toward the base 22. The extension 70 is spaced apart from the base 22 when the control bar 14 is in the unstressed position of FIG. 1, and contacts the base 22 when the control bar 14 is depressed and the device 10 is in the loaded position 10A. In FIG. 3, the extension 70 is indicated as 70A with the device 10 in the loaded position 10A. Contact of the extension 70 with the base 22 limits further depression of the control bar 14. Alternatively, the base 22 could have an extension instead of or in addition to the control bar 14, with the extension on the base extending toward the control bar 14.

In the embodiment of FIGS. 1-6, the control bar 14 and the base 22 have complementary features that interface to limit movement of the device during depression of the control bar 14. For example, the extension 70 interfaces with the base 22, limiting depression of the control bar 14, and limiting tilting of the control bar 14 toward the lateral or medial side during loading. More specifically, the base 22 has a recess 72, and the extension 70 protrudes into the recess 72 and contacts the base 22 when the control bar 14 is depressed and the device 10 elastically deforms to the loaded position 10A. When in the recess 72, side protrusions 74 on either side of the recess 72 prevent sideways movement of the extension 70. Because the control bar 14 generally comes down along an arc when the joints 24A, 24B bend, the extension 70 is positioned so that it will interface with the base 22 in the recess 72 when it descends along such an arc.

Figure 7:
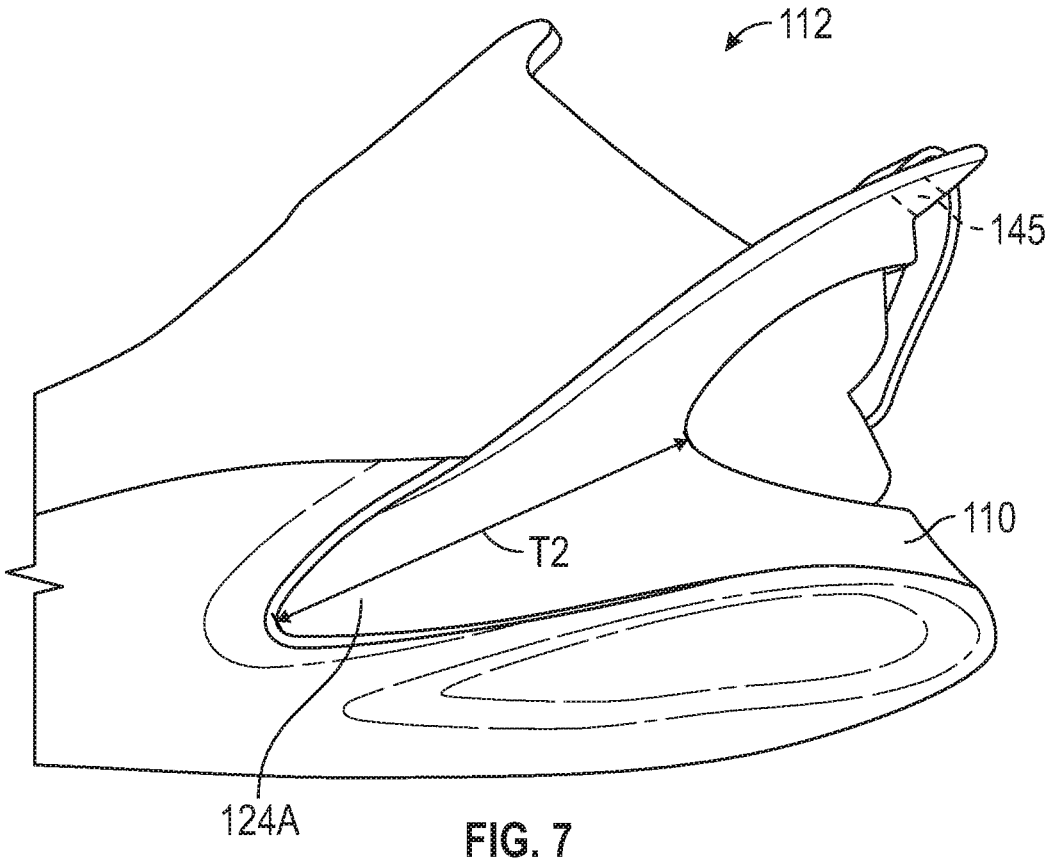
FIG. 7 is a schematic illustration in fragmentary side view of a medial side of an alternative embodiment of an article of footwear including an alternative heel spring device.
Figure 8:
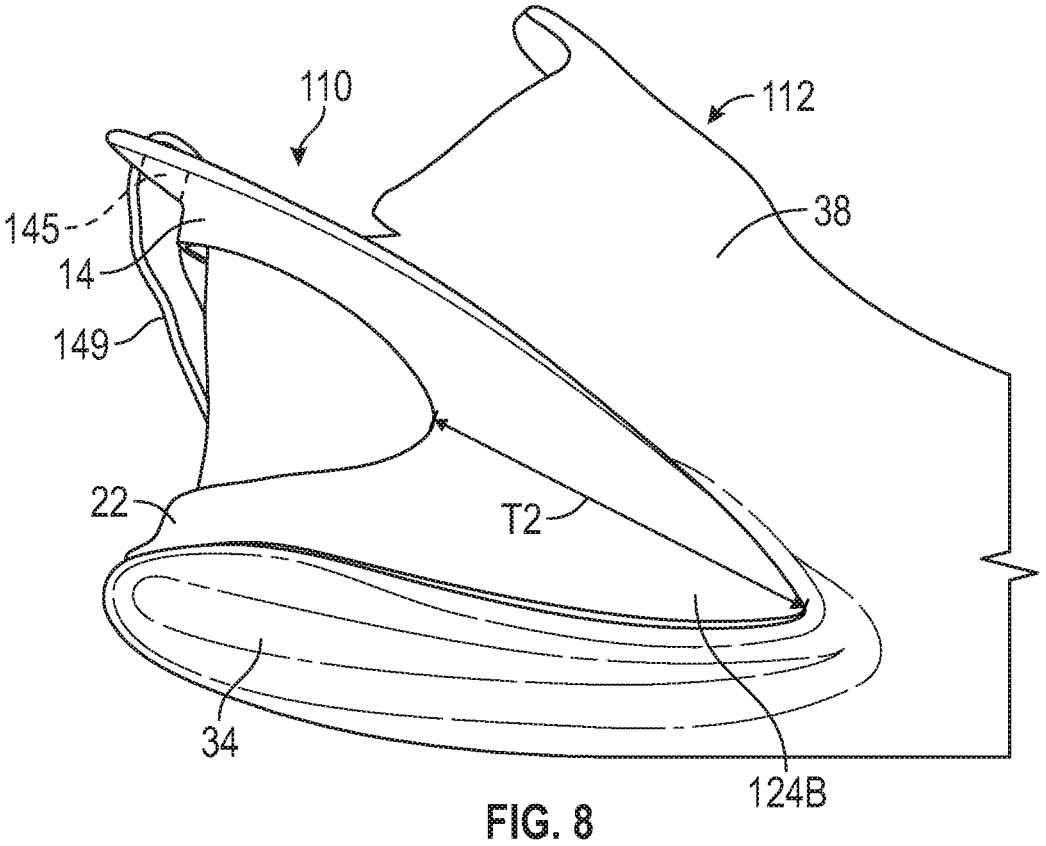
FIG. 8 is a schematic illustration in fragmentary side view of a lateral side of the article of footwear of FIG. 7.

FIGS. 7 and 8 show another embodiment of an article of footwear 112 with a heel spring device 110. The heel spring device 110 has similar functions and features as heel spring device 10. Joints 124A, 124B have a greater thickness T2 than the thickness T1 of joints 24A, 24B and thus may provide greater resistance to depression of the control bar 14 lessening the need for an extension 70 to limit bending. The center segment 16 has an aperture 145, and the upper 38 has a heel pull tab 149 that extends through the aperture 145, further securing the upper 38 to the device 110. After insertion through the aperture 145, the heel pull tab 149 can wrap around the device 110, could be left hanging loose, or could be stitched or fastened to the upper 38 or to itself to secure the upper 38 to the device 10.

Figure 9:
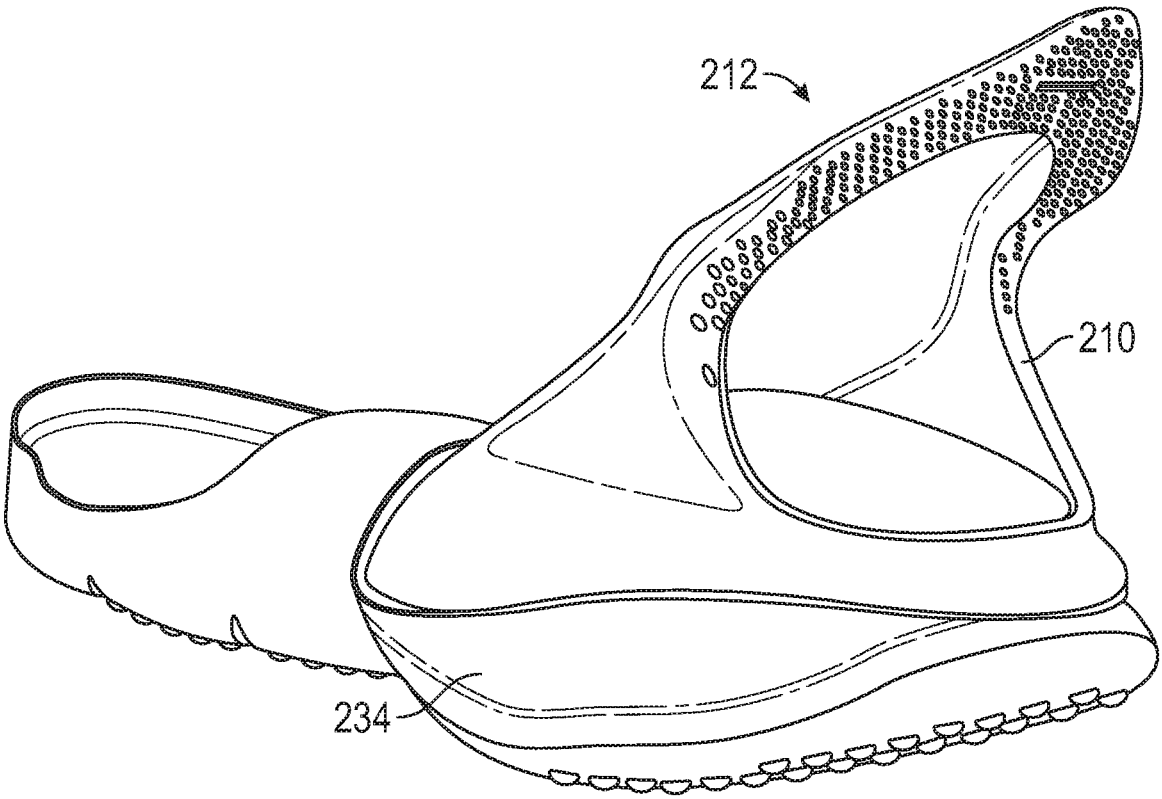
FIG. 9 is a schematic illustration in perspective view of an alternative embodiment of an article of footwear including an alternative heel spring device.
Figure 10:
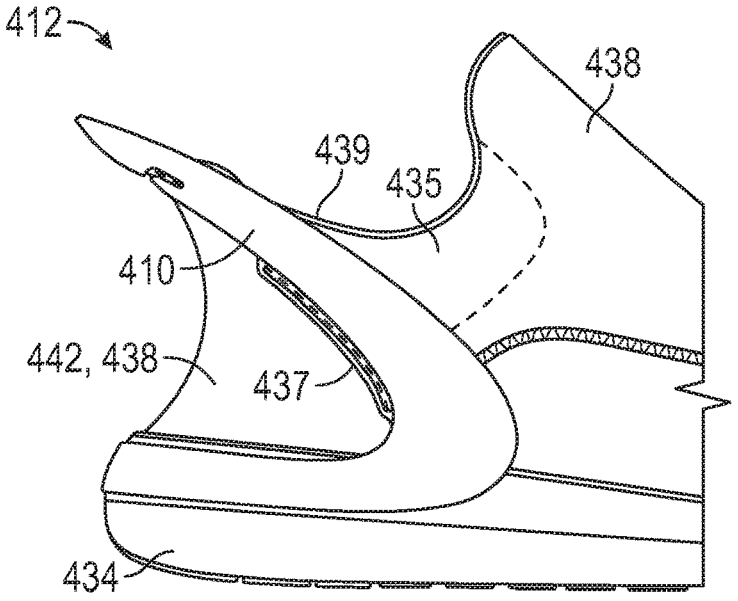
FIG. 10 is a schematic illustration in fragmentary side view of a lateral side of an alternative embodiment of an article of footwear including an alternative heel spring device.

FIG. 9 shows another embodiment of an article of footwear 212 with a heel spring device 210 secured to a sole layer 234. The heel spring device 210 has similar functions and features as heel spring device 10. An upper is not shown, but would be secured to the sole layer 234 and to the device 210 as described with respect to device 10.

FIGS. 10-13 show another embodiment of an article of footwear 412 that has a heel spring device 410 with similar functions and features as heel spring device 10. The heel spring device 410 is secured to a sole layer 434 and to an upper 438 that has a flexible covering 442 with an elastically stretchable material in the heel region for receiving and covering a foot supported on the sole layer 434. For example, the flexible covering 442 may be an elastically stretchable fabric, such as a 4-way stretch nylon fabric. A foam collar 435 is secured to the flexible covering 442 and defines a front portion of an ankle opening 439 in the upper 438. The foam collar 435 is stiffer than the elastically stretchable fabric of the flexible covering 442. The collar 435 may include foam padding 435A. The foam padding 435A at a rear portion of the collar may protrude inward into the ankle opening 439. Because the foam is compressible, this enables the size of the opening to be adjustable to different ankle girths.

Figure 11:
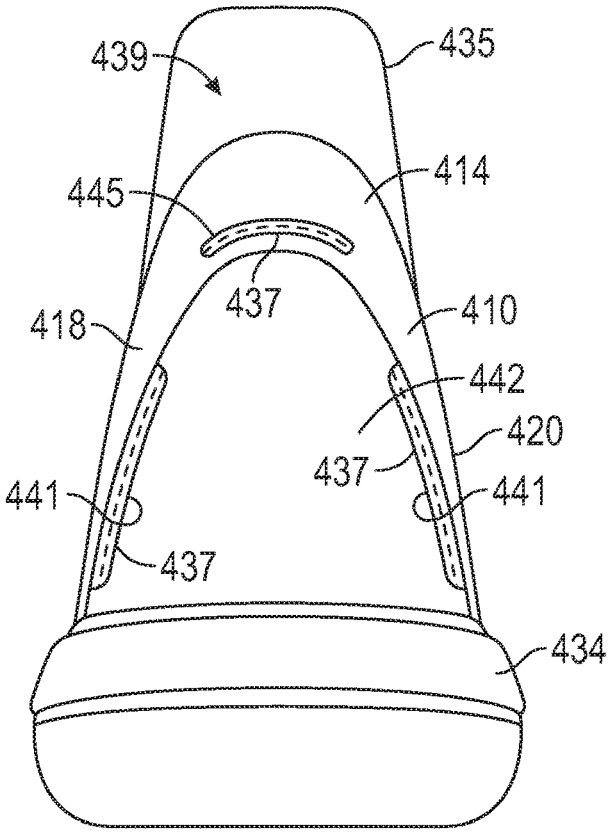
FIG. 11 is a schematic illustration in rear view of the article of footwear of FIG. 10.
Figure 12:
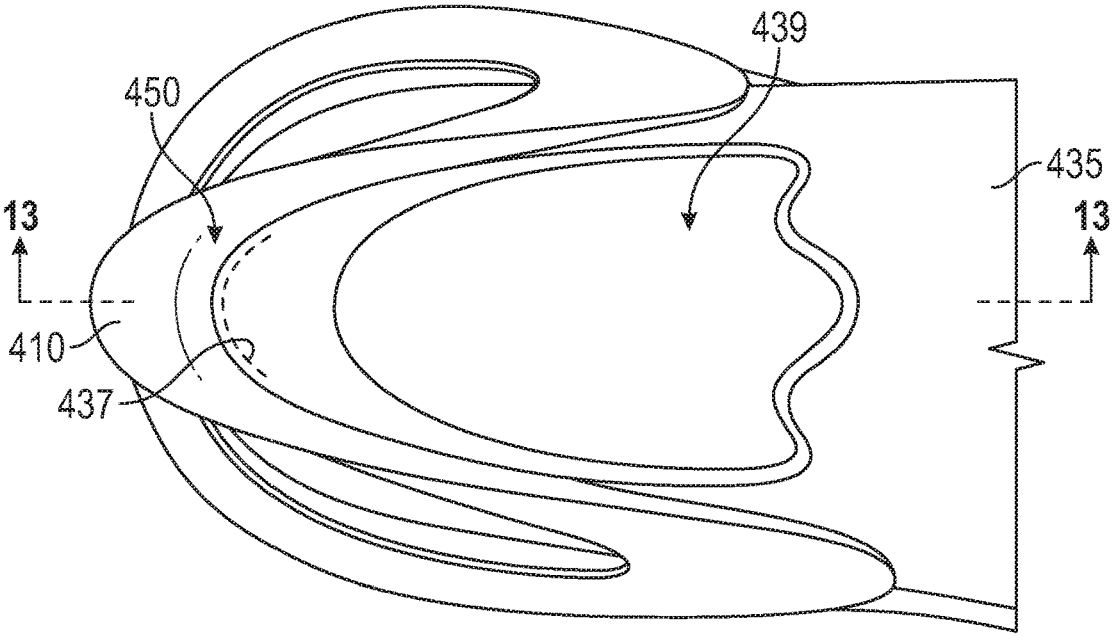
FIG. 12 is a schematic illustration in fragmentary plan view of the article of footwear of FIG. 10.
Figure 13:
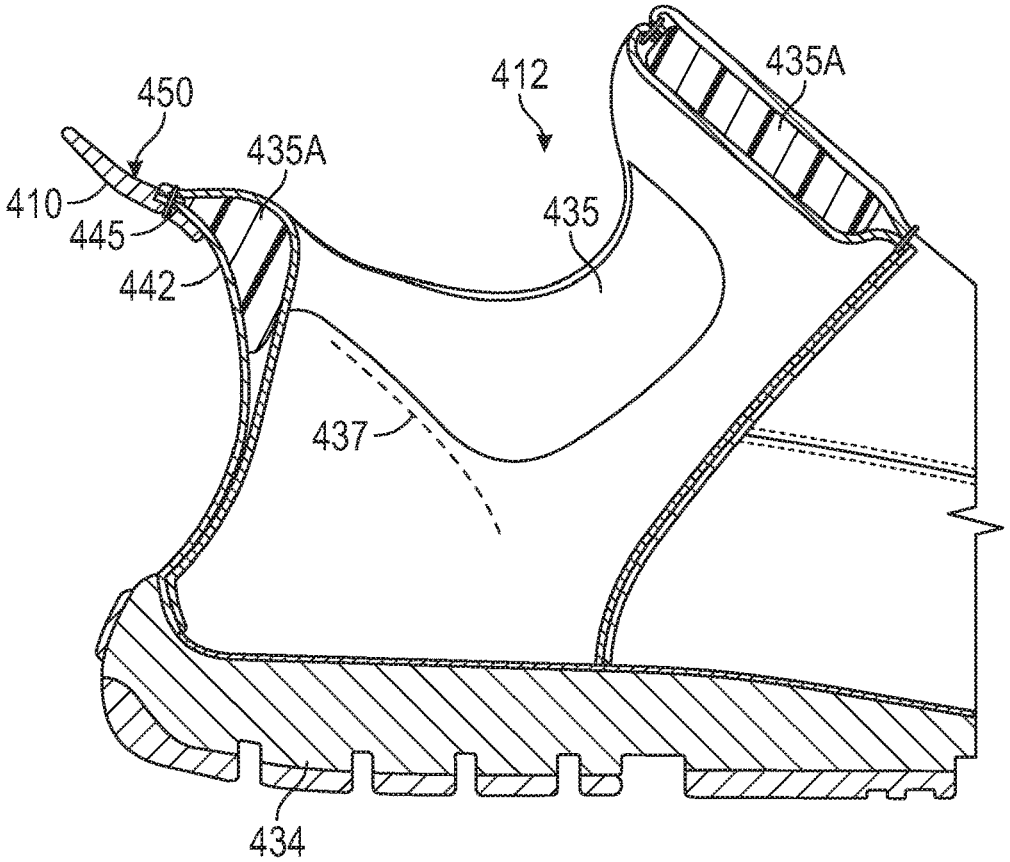
FIG. 13 is a schematic illustration in fragmentary cross-sectional view of the article of footwear of FIG. 12 taken at lines 13-13 in FIG. 12.

A center segment of the control bar 414 of the device 410 has a thinned portion 445 where the flexible covering 442 of the upper 438 is stitched to the device 410. The foam collar 435 is also stitched to the device 410 at the thinned portion 445 as shown in FIG. 13. Additional thin extensions 441 of the device 410 run along the side arms 418, 420, as shown in FIG. 11, and are sufficiently thin to allow stitching of the upper 438 through the thin extensions 441 to the device 410. The stitching 437 through the thinned portion 445 and through the extensions 441 is shown in FIGS. 12 and 13. The upper 438 is characterized by the absence of a rigid heel counter covering the rear of the heel region 13. The device 410 functions at least in some respects as a heel counter in that it helps to retain a wearer's heel in position atop a heel portion of the sole structure, preventing medial or lateral displacement during use. Similar to device 10, the device 410 has a ramped surface 450 for easing foot entry.

Figure 14:
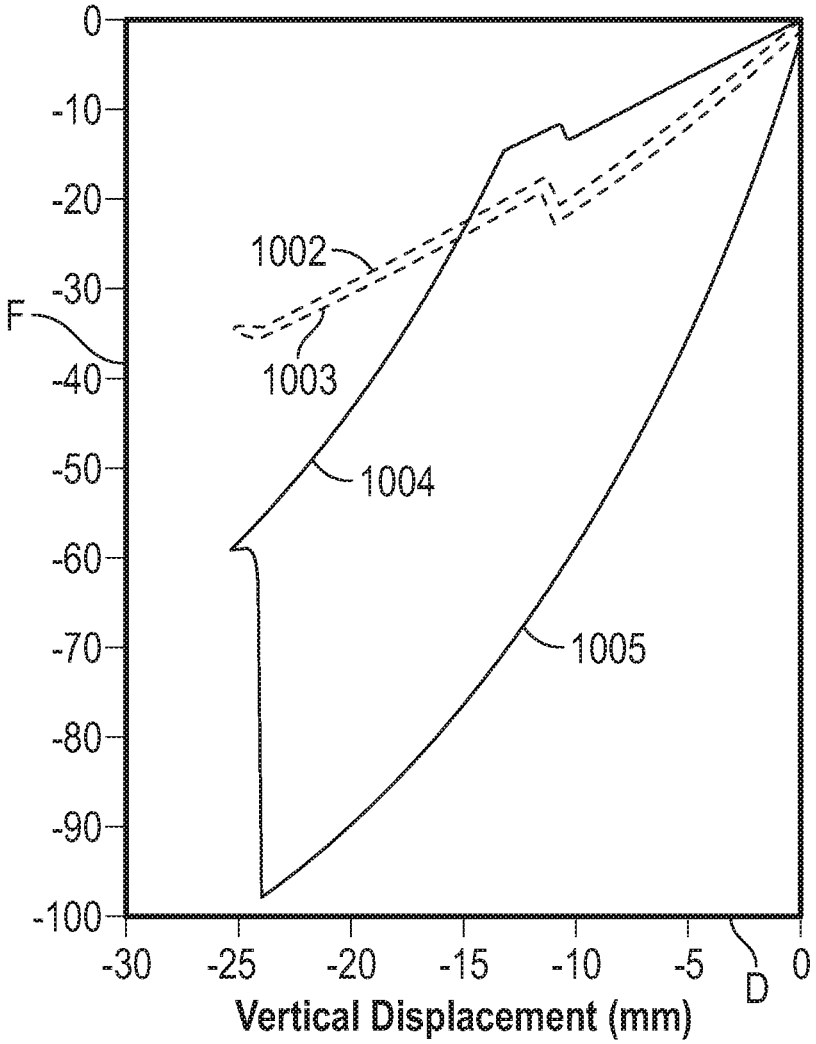
FIG. 14 shows representative plots of force in Newtons versus displacement in millimeters during loading and unloading of heel spring devices within the scope of the present teachings.

FIG. 14 shows an example diagram of vertical force F in Newtons on the vertical axis versus displacement D in millimeters on the horizontal axis schematically representing the elastic bending and energy-returning behavior of any of the heel spring devices shown and described herein. The displacement D is, for example, the difference between the distances D1 and D2 in FIG. 3. A first example representation of the behavior of a heel spring device is shown by a loading curve 1003 (placement of the force F of FIG. 4 on the control bar of the device (the vertical component of which is represented in the plots)) followed by an unloading curve 1002 (behavior when the force F is removed). A second example representation of the behavior of a heel spring device is shown by a loading curve 1005 followed by an unloading curve 1004.

Figure 15:
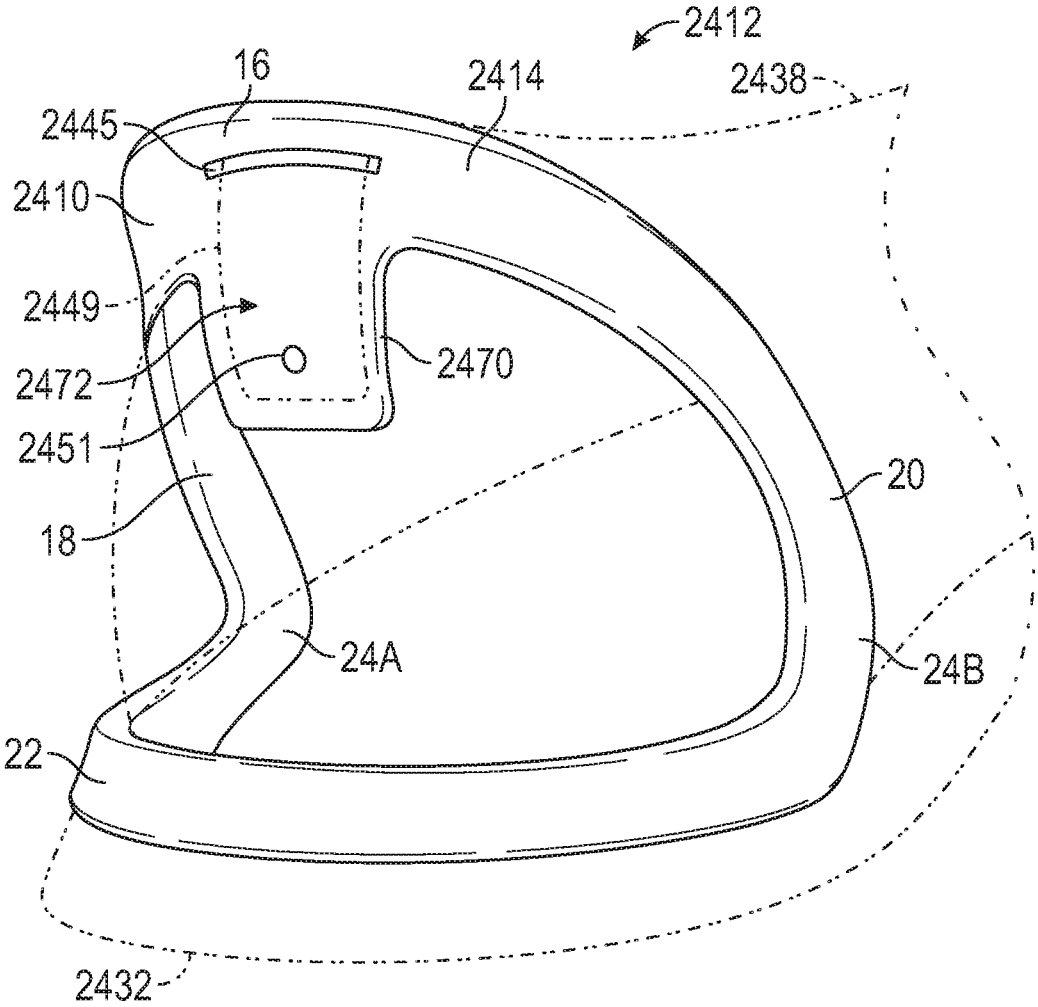
FIG. 15 is a schematic illustration in perspective view of an alternative embodiment of a heel spring device in an unloaded position and showing a fragmentary upper and sole structure in phantom.

FIG. 15 shows an article of footwear 2412 with another embodiment of a heel spring device 2410. The heel spring device 2410 has similar functions and features as heel spring device 10. The device 2410 has a control bar 2414 with a medial side arm 18 and a lateral side arm 20, and a center segment 16 connecting the side arms 18, 20 and from which the side arms extend generally downwardly and forwardly. The device 2410 has a continuous base 22 that connects the side arms 18, 20 at first and second joints 24A, 24B, described with respect to FIG. 1. The device 2410 is secured to a flexible footwear upper 2438 and to a sole structure 2432 similarly as described with respect to device 10.

The center segment 16 has an aperture 2445, and the upper 2438 has a heel pull tab 2449 that extends through the aperture 2445, further securing the upper 2438 to the device 2410. The center segment 16 also has an extension 2470 that extends downward from the center segment 16 and may limit bending of the device 10 by interference with the base 22, preventing plastic deformation similarly as described with respect to extension 70. The extension 2470 has a fastener opening 2451 that receives a stud (not shown) that can be used to secure the heel pull tab 2449 to the extension 2470. Alternatively, or in addition, the heel pull tab 2449 may be secured to a mounting surface 2472 of the extension 2470 with another fastener such as a snap or a button, or with adhesive or otherwise.

Figure 16:
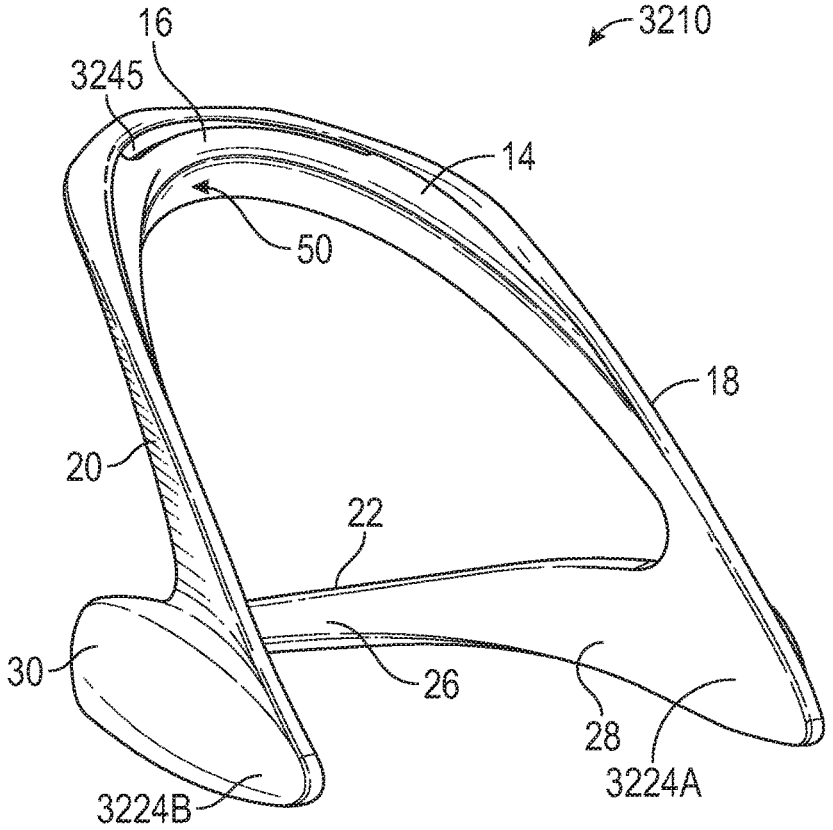
FIG. 16 is a schematic illustration in perspective view of an alternative embodiment of a heel spring device in an unloaded position.
Figure 17:
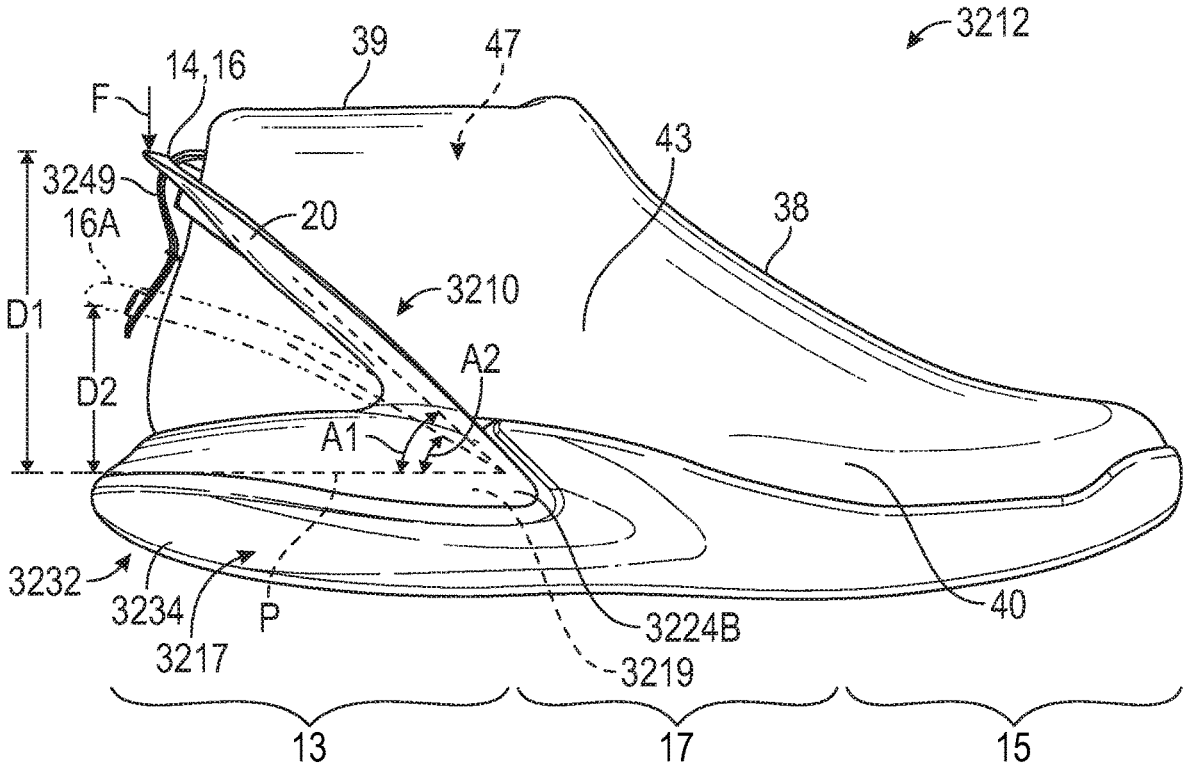
FIG. 17 is a schematic illustration in lateral side view of an article of footwear with the heel spring device of FIG. 16.
Figure 18:
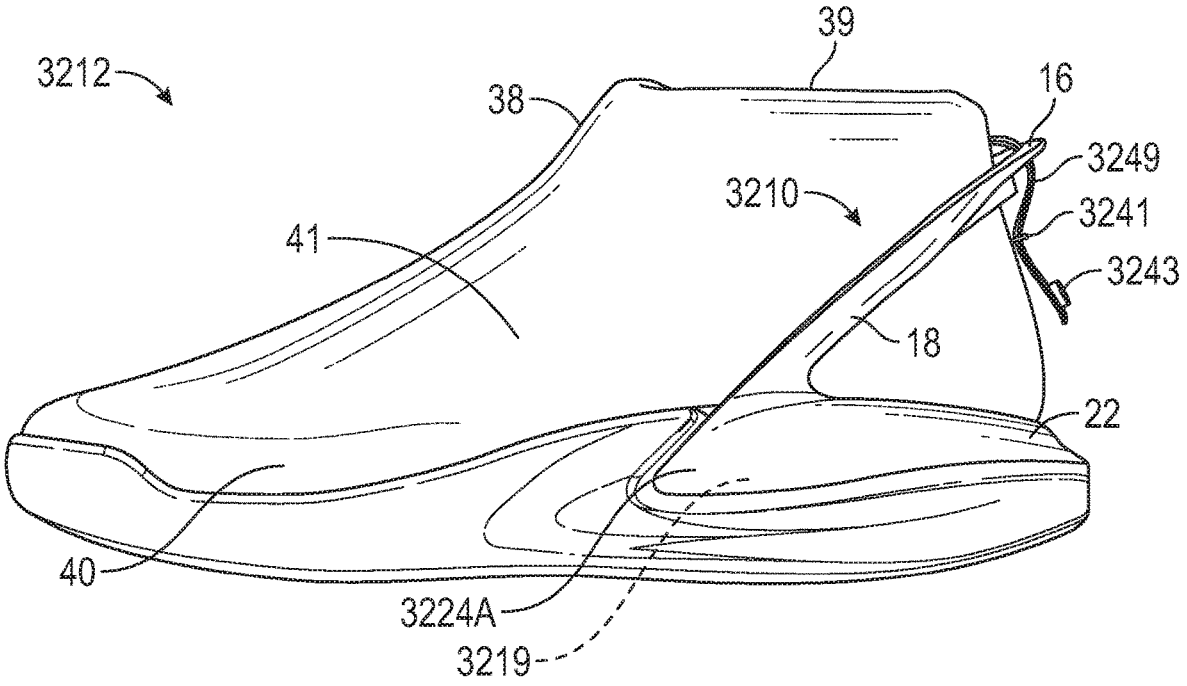
FIG. 18 is a schematic illustration in medial side view of the article of footwear of FIG. 17.
Figure 19:
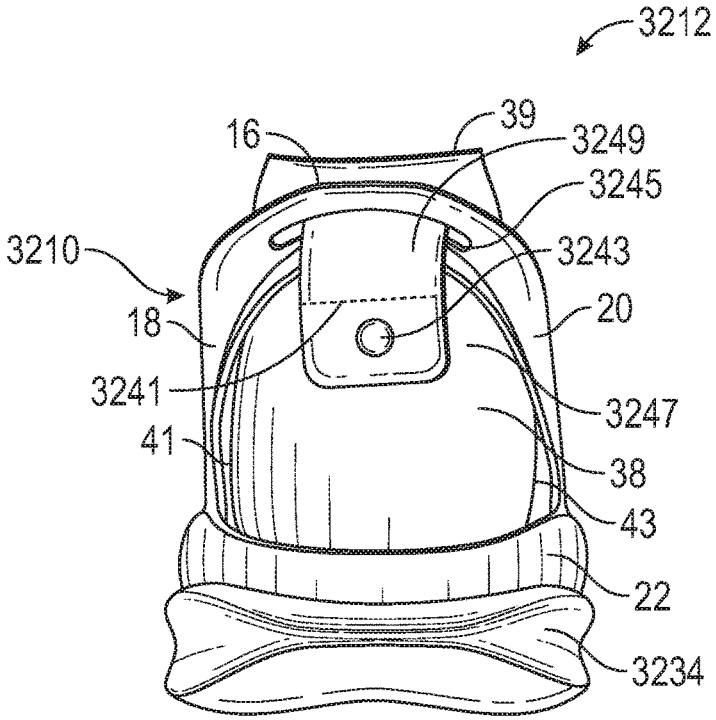
FIG. 19 is a schematic illustration in rear view of the article of footwear of FIG. 17.

FIG. 16 shows another embodiment of a heel spring device 3210 for an article of footwear 3212 shown in FIGS. 17-19. The heel spring device 3210 has similar function and features as heel spring device 10. For example, the device 3210 has the control bar 14 with the medial side arm 18 and lateral side arm 20. The device 3210 has the continuous base 22 that connects the side arms 18, 20 and extends rearward from a junction of the control bar 14 with the base 22. The base 22 underlies the control bar 14 with the first side arm 18 at a medial side 41 of a footwear upper 38, the second side arm 20 at a lateral side 43 of the footwear upper 38, and the center segment 16 of the control bar 14 rearward of the ankle opening 39 of the footwear upper 38.

The base 22 supports the control bar 14 and is connected to the control bar 14 at resiliently bendable junction 3224A, 3224B. The base 22 is continuous and extends between and connects to the first side arm 18 and the second side arm 20. The base 22 is continuous in that it is without breaks or connections through other components in extending from the first side arm 18 to the second side arm 20. The base 22 has a center segment 26, a first base arm 28, and a second base arm 30 all disposed in a common plane, as described with respect to the device 10 of FIG. 3. The first base arm 28 is spaced apart from the second base arm 30 and both extend from the center segment 26 of the base 22.

The junction 3224A, 3224B includes a first joint 3224A at which the base 22 and the first side arm 18 connect, and a second joint 3224B at which the base 22 and the second side arm 20 connect. The first joint 3224A is the connection of the first base arm 28 to the first side arm 18. The second joint 3224B is the connection of the second base arm 30 to the second side arm 20. The joints 3224A, 3224B may be referred to herein as hinged joints, or as a hinged junction.

The control bar 14 has an arced shape from the first joint 3224A to the second joint 3224B. Similarly, the base 22 has an arced shape from the first joint 3224A to the second joint 3224B. With this arrangement, the control bar 14 and the base 22 are configured as a full elliptical leaf spring as described herein. The device 3210 may be referred to as a heel spring. Additionally, the device 3210 is a single, unitary, one-piece component. For example, the device 3210 may be injection molded as a single, unitary, one-piece component.

The center segment 16 of the control bar 14 has the ramped surface 50 that declines toward an inner periphery of the center segment 16 between the first side arm 18 and the second side arm 20 and helps direct the foot downward and forward into the foot-receiving cavity 47 during application of the downward force F on the control bar 16 as described with respect to device 10. Additionally, the first side arm 18 and the second side arm 20 are each twisted outwardly along their respective longitudinal axis from the junction 3224A, 3224B near the base 22 to the center segment 16 of the control bar 14. The outward twist helps to encourage the down and back movement of the center segment 16 during loading by the foot.

The article of footwear 3212 includes a sole structure 3232, and the flexible footwear upper 38 has a medial side 41 and a lateral side 43, and defines an ankle opening 39 and a foot-receiving cavity 47, as described with respect to the article of footwear 12. The sole structure 3232 includes one or more sole components that may be sole layers, such as an outsole, a midsole, or a sole layer 3234 that is a unitary combination of an outsole and a midsole and may be referred to as a unisole. The sole layer 3234 underlies the upper 38 and the foot-receiving cavity 47 defined by the upper 38. A lower portion 40 of the footwear upper 38 is secured to the sole layer 3234, such as by adhesive or otherwise. The base 22 is secured to the sole layer 3234 such as by bonding with adhesive, thermal bonding, or otherwise.

Figure 20:
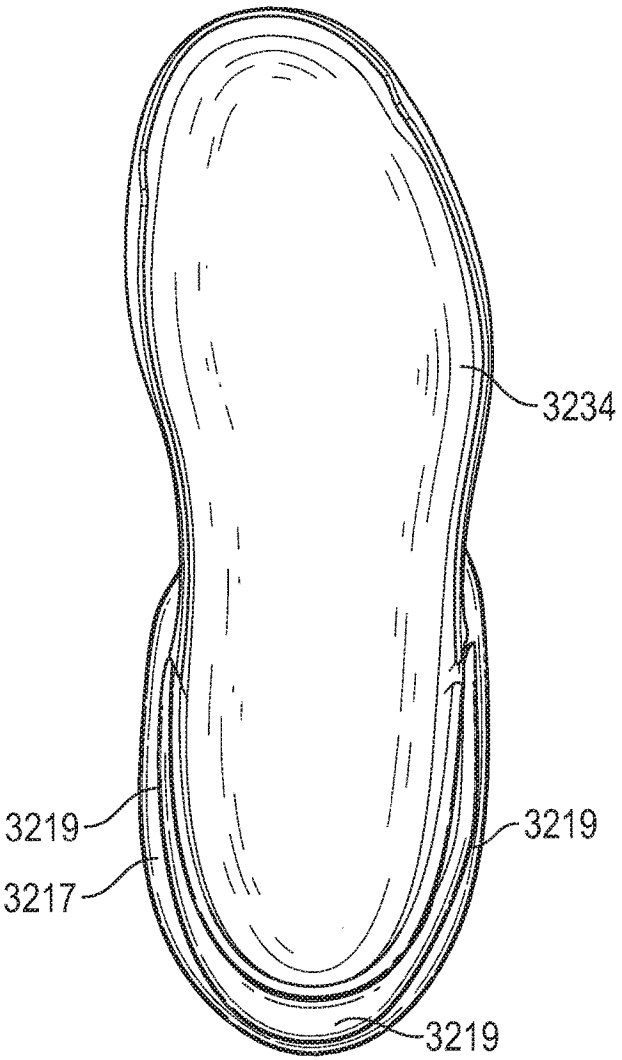
FIG. 20 is a schematic illustration in plan view of a midsole of the article of footwear of FIG. 17.

As best shown in FIG. 20, the sole layer 3234 has a slight recess 3219 in the outer wall 3217 of the sole layer 3234 (i.e., in the outer side walls and rear wall in the heel region of the sole layer 3234). The recess 3219 is shaped to allow the base 22 and joints 3224A, 3224B to partially nest in the recess 3219. The portions of the base 22 and the joints 3224A, 3224B nested in the recess 3219 are secured to the outer wall 3217 of the sole layer 3234 in the recess 3219. The device 3210 is thus supported by the sole layer 3234 in the recess 3219.

The control bar 14 is biased to an unloaded position shown in FIGS. 17 and 19. The unloaded position is also referred to herein as an unstressed position. The control bar 14 is internally biased to the unstressed position by its material in its formed state. Stated differently, the material of the control bar 14 is sufficiently rigid that it remains in the unstressed position in its natural state without external loads applied to it, and will return to the unstressed position after elastic bending due to its resiliency. In the unstressed position, the center segment 16 is a first distance D1 from the bottom of the center segment 26 of the base 22, as indicated in FIG. 17 by a distance D1 from the top of the center segment 16 of the control bar 14 to the bottom of the center segment 26 of the base 22. The unstressed position is the position of the device 3210 in a relaxed, unloaded state (i.e., without a vertical force applied to the control bar 14).

The control bar 14 can be depressed under an applied force F shown in FIG. 17, representing the force applied by a foot during insertion of the foot into the foot-receiving cavity 47 (see, e.g., FIGS. 5 and 6) of the article of footwear 3212. When loaded in this manner, the control bar 14 elastically bends to a loaded position in which the top of the center segment 16 is a second distance D2 from the bottom of the center segment 26 of the base 22. The loaded position is shown in FIG. 17, in which the control bar 14 and the center segment 16 are indicated with phantom lines, and the center segment is indicated with reference number 16A in FIG. 17. The second distance D2 is less than the first distance D1. The difference between the distances D1 and D2 is the deflection of the device 3210, which may be but is not limited to a deflection of 30 mm. The device 3210 is configured so that when it is depressed under the force F to the loaded position at D2, it elastically bends at the junction 3224A, 3224B, storing elastic energy. When the force F is removed, the stored elastic energy returns the control bar 14 to the unstressed position. Like device 10, the first side arm 18 and the second side arm 20 extend at a first acute angle A1 to the common plane P of the base 22 when the control bar 14 is in the unloaded position. The first side arm 18 and the second side arm 20 extend at a second acute angle A2 to the common plane P of the base 22 when the control bar 14 is depressed. The second acute angle A2 is less than the first acute angle A1.

As best indicated in FIG. 19, the base 22 extends around a rearmost portion of the footwear upper 38 from the lateral side 43 to the medial side 41. As indicated in FIG. 19, the device 3210 is not secured to the upper 38 at the medial side 41 or the lateral side 43. Instead, the device 3210 is only secured to the upper 38 via a heel tab 3249 that extends through an aperture 3245 in the center segment 16. The tab 3249 is then stitched to a rear portion 3247 of the upper 38 at stitching 3241. A decorative snap 3243 may be secured to the tab 3249. However, in the embodiment shown, the decorative snap 3243 is merely decorative in that it does not snap or otherwise fasten to the upper 38.

Figure 21:
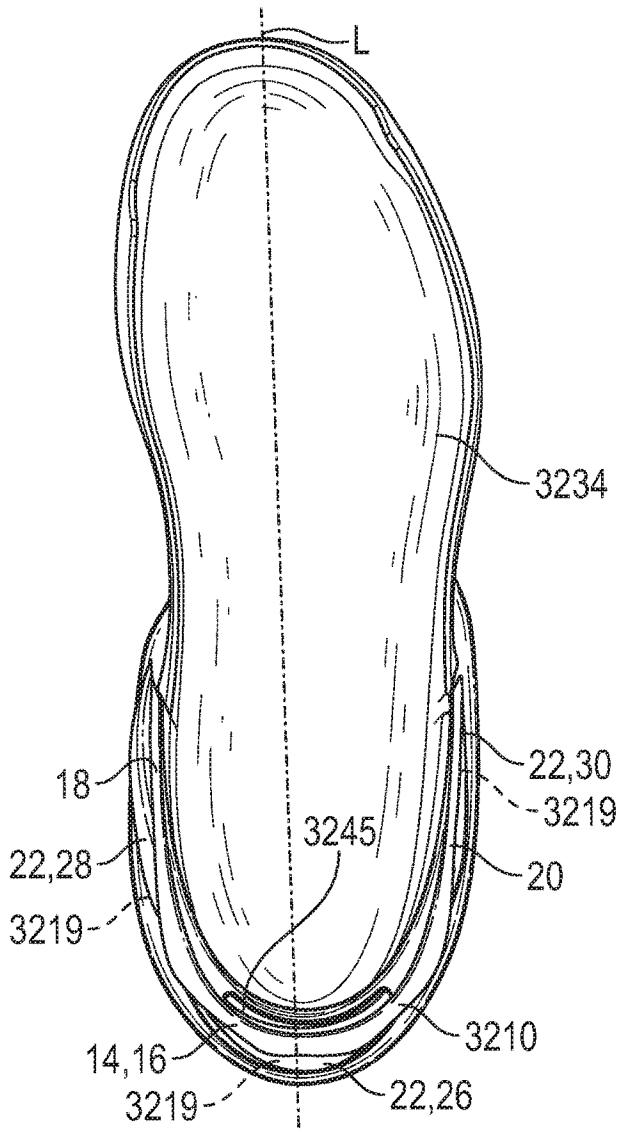
FIG. 21 is a schematic illustration in plan view of the midsole of FIG. 20 with the heel spring device of FIG. 16 nested in a recess in the midsole.

FIG. 21 best illustrates that the medial side arm 18 and the lateral side arm 20 are asymmetrical about a longitudinal axis L extending between the medial side arm 18 and the lateral side arm 20 through the base 22. The medial side arm 18 is also referred to herein as a first side arm, and the lateral side arm 20 is also referred to as a second side arm. The medial side arm 18 may be shorter than the lateral side arm 20 and may be have a greater lateral (i.e., outward) curvature than the lateral side arm, similar to the shape of a typical heel region of a foot. Because the heel spring device 3210 is asymmetrically shaped in this manner following a typical foot shape, pressure of the heel spring device 3210 against the sides of the foot during wear is thus minimized.

Figure 22:
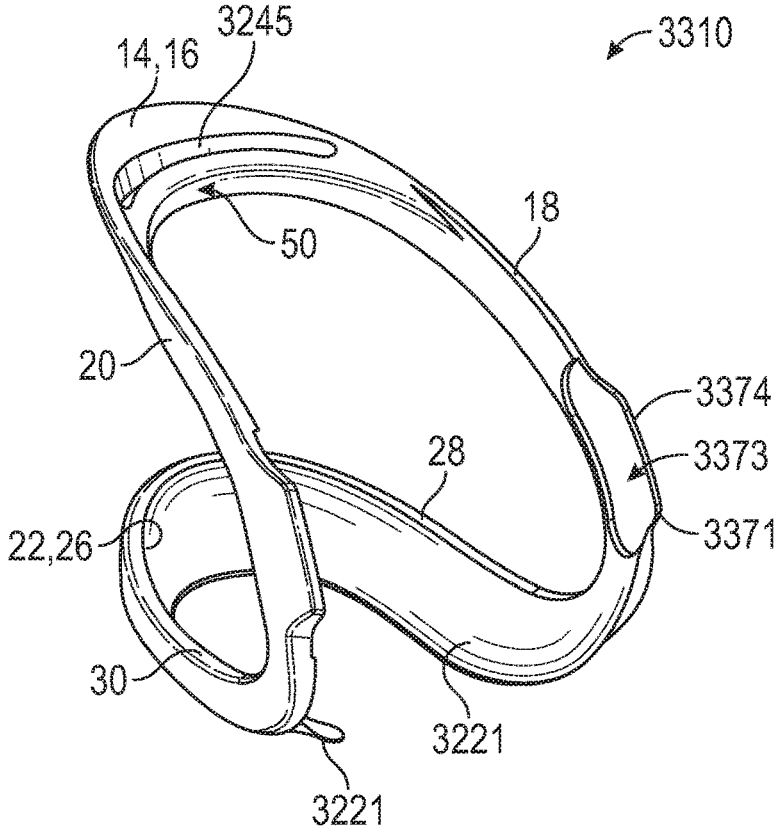
FIG. 22 is a schematic illustration in perspective view of an alternative embodiment of a heel spring device in an unloaded position.
Figure 23:
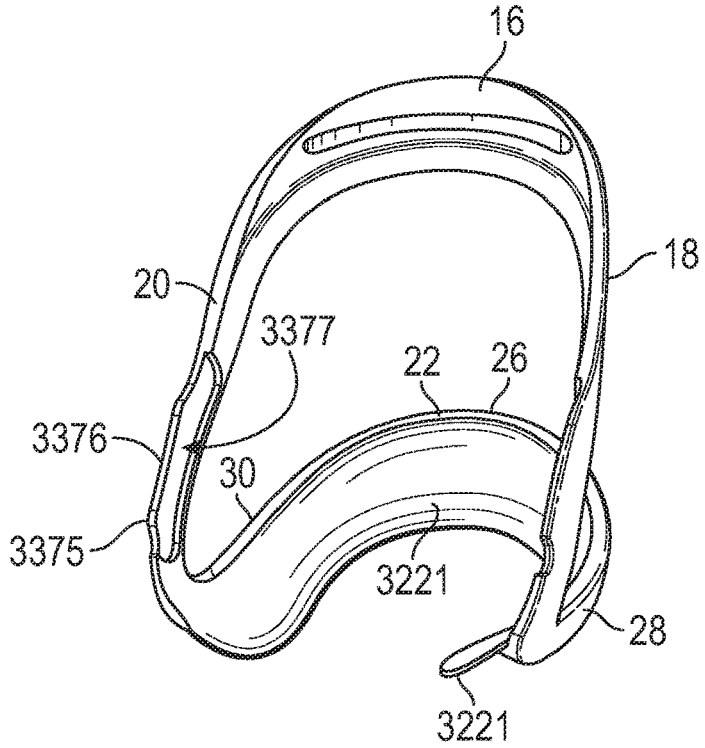
FIG. 23 is a schematic illustration in another perspective view of the heel spring device of FIG. 22.

FIGS. 22-23 illustrate another embodiment of a heel spring device 3310 that has many of the same features as heel spring device 10, 3210, which features are referenced with like reference numbers. Additionally, the base 22 has an inwardly-extending flange 3221 that extends continuously from the medial base arm 28, around the center segment 26 to the lateral base arm 30 such that the flange 3221 generally has a U-shape.

Figure 24:
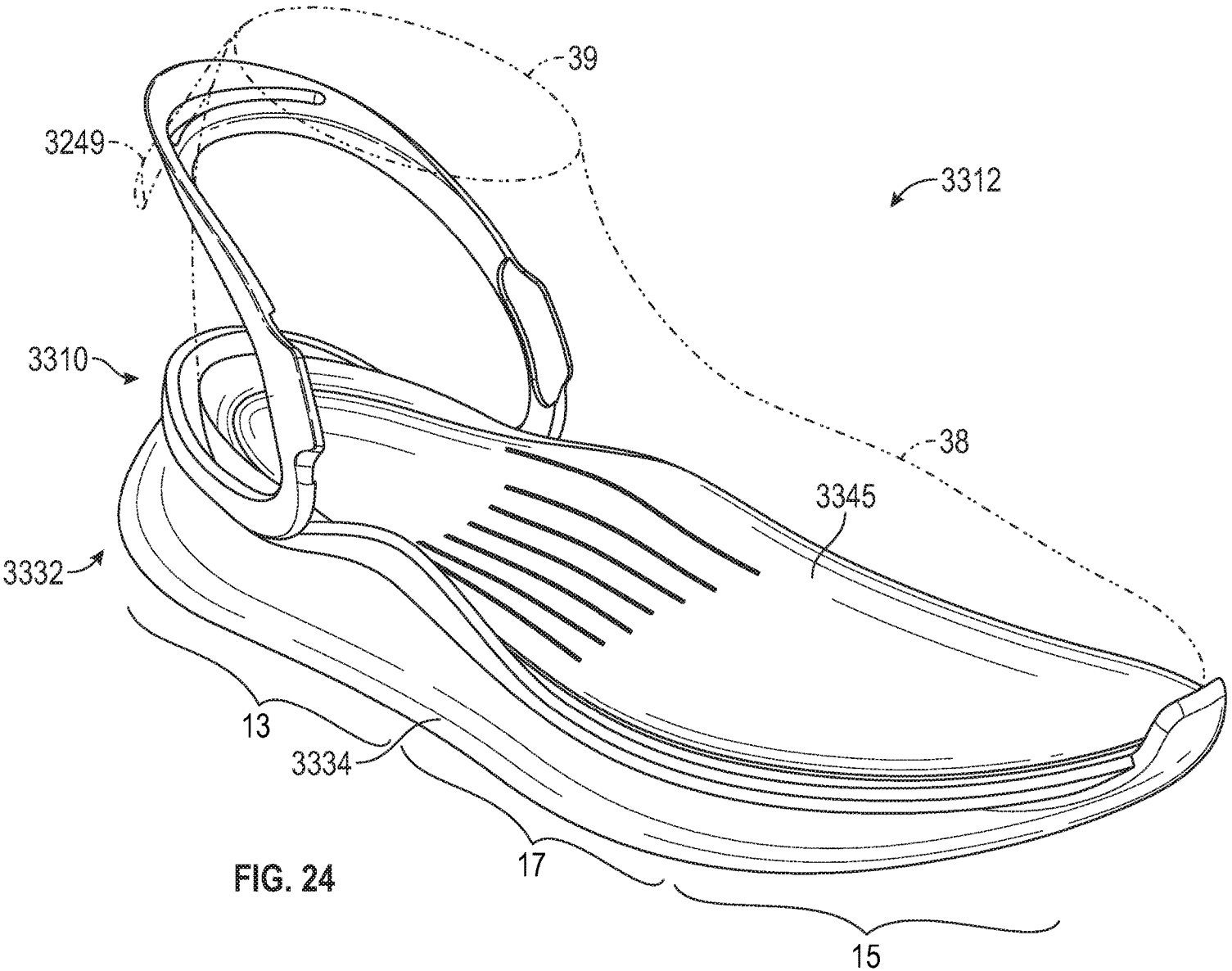
FIG. 24 is a schematic illustration of an article of footwear with the heel spring device of FIG. 22 and showing an upper in phantom.
Figure 27:
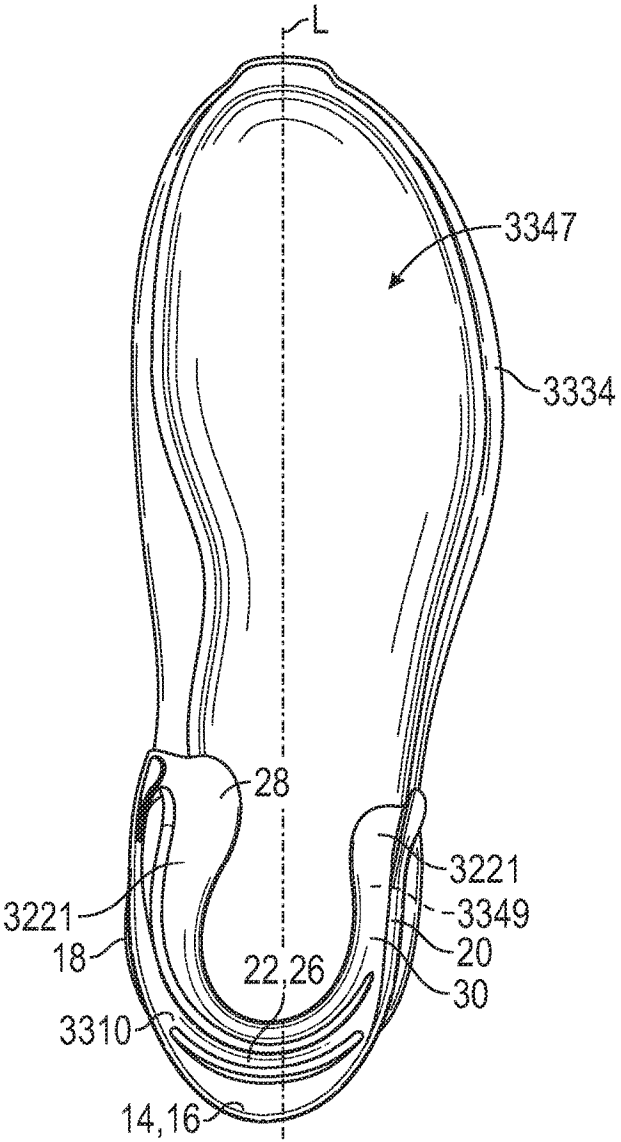
FIG. 27 is a schematic illustration in plan view of the heel spring device of FIG. 22 nested in a recess of the midsole of FIG. 26.
Figure 26:
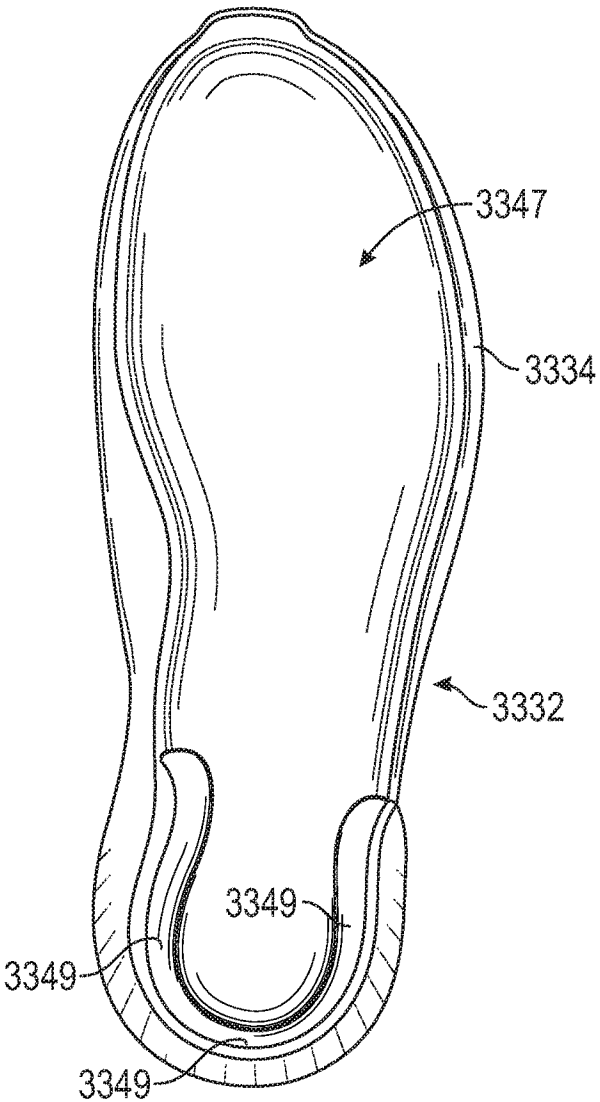
FIG. 26 is a schematic illustration in plan view of a midsole of the article of footwear of FIG. 24.

With reference to FIG. 24, the heel spring device 3310 is included in an article of footwear 3312 that has an upper 38 and a sole structure 3332. The upper 38 is as described herein with respect to heel spring device 10, and is shown only in phantom in FIG. 24. The sole structure 3332 includes an outer sole layer 3334 that may serve as a unitary outsole and midsole. The sole structure 3332 also includes an inner sole layer 3345, also referred to as an insole, that overlays the sole layer 3334. FIG. 26 shows the sole layer 3334 alone with the inner sole layer 3345 removed. The sole layer 3334 has a recess 3349 in an upper surface 3347. The recess 3349 is shaped so that the flange 3221 is seated in and at least partially nested in the recess 3349, and secured to the upper surface 3347 in the heel region of the sole structure 3332. FIG. 27 shows the flange 3221 seated in the recess 3349. The heel spring device 3310 is secured to the sole layer 3334 by securing the flange 3221 to upper surface 3347 of the sole layer 3334 in the recess 3349 by thermal bonding, by adhesive, or otherwise. The inner sole layer 3345 is then inserted in the upper 38 to rest on the sole layer 3334 over the flange 3221 and at the upper surface 3347 of the sole layer 3334.

As best indicated in FIG. 27, the heel spring device 3310 is asymmetric about the longitudinal axis L. More specifically, the medial side arm 18 curves laterally outward more than the lateral side arm 20, and is also longer in a fore-aft direction (along the longitudinal axis L) than the lateral side arm 20. As discussed with respect to heel spring device 3210, this is a more anatomical shape than a symmetrical heel spring device, and avoids undesirable friction and pressure of the side arms 18, 20 on the foot.

Figure 25:
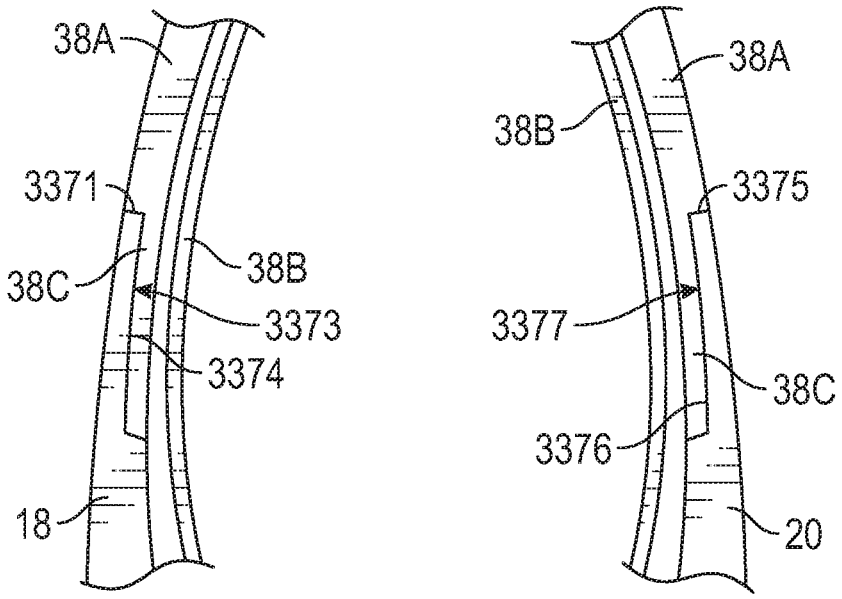
FIG. 25 is a schematic fragmentary plan view of arms of the heel spring device of FIG. 22 connected with a component of a footwear upper.

The heel spring device 3310 is configured to secure to the upper 38 at forwardmost portions of the side arms 18, 20, and via a heel tab extending through an aperture 3245 of the center segment 16 as indicated with respect to the upper 38 shown in phantom in FIG. 24. More specifically, a forwardmost portion 3371 of an inner surface 3373 of the first side arm 18 includes a medial recess 3374 such that the first side arm 18 is thinner at the medial recess 3374 than rearward of the medial recess 3374. A forwardmost portion 3375 of an inner surface 3377 of the second side arm 20 includes a lateral recess 3376 such that the second side arm 20 is thinner at the lateral recess 3376 than rearward of the lateral recess 3376. The upper 38 may be secured to the first side arm 18 at the medial recess 3374 and to the second side arm 20 at the lateral recess 3376. For example, the upper 38 may be bonded to the side arms 18, 20 at the recesses 3374, 3376. In some embodiments, the upper may include an inner portion 38B, and an outer portion 38A, as shown in FIG. 25. In such embodiments, the outer portion 38A may include rearward-extending flanges 38C that are thinner than more forward portions of the outer portion 38A. The flanges 38C interfit with and are secured to the inner surfaces 3373, 3377 of the side arms 18, 20 in the recesses 3374, 3376. The outer portion 38A may be less flexible than the inner portion 38B, and may thus provide better anchoring support to the device 3310 at the side arms 18, 20 than would the inner portion 38B.

Figure 28:
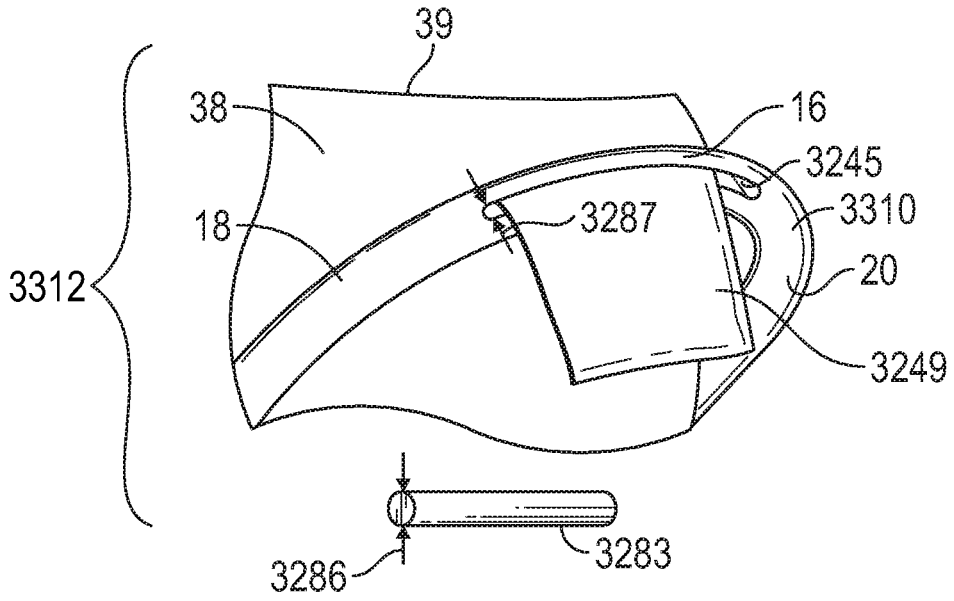
FIG. 28 is an exploded fragmentary view of the heel spring device of FIG. 22 with a tab of the upper extending through an aperture in the heel spring device, and showing a pin.
Figure 29:
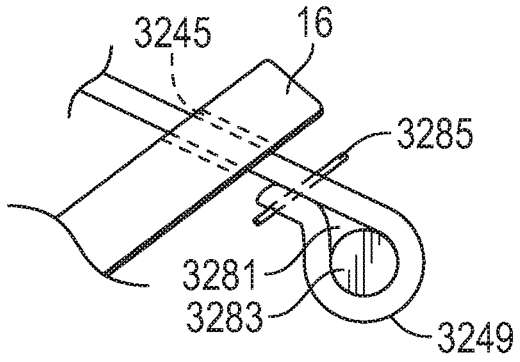
FIG. 29 is a fragmentary view of the heel spring device of FIG. 28 with the tab secured in a loop and with the pin inserted in the loop.

In addition to attaching to the upper 38 (or outer portion 38A) at the forwardmost portions 3371, 3375, the upper 38 may be secured to the heel spring device 3310 via a heel tab 3249 (see FIGS. 24 and 28). The heel tab 3249 extends through an aperture 3245 in the center segment 16. After the tab 3249 is extended through the aperture 3245, the tab 3249 may be folded over in a loop and stitched to itself at stitching 3285 as shown in FIG. 29. A pin 3283 may then be inserted into an opening 3281 in the loop of the tab 3249. The pin 3283 may be secured to the tab 3249 in the opening 3281 rearward of the aperture 3245, such as by inserting adhesive into the opening 3281. The tab 3249 with the pin 3283 therein may be wider than the aperture 3245. For example, the pin 3283 has a width 3286 (see FIG. 28) which is greater than the width 3287 of the aperture 3245. With the pin 3283 inserted into the looped tab 3249, after pulling the tab 3249 through the aperture 3245, the pin 3283 helps retain the tab 3249 in its position extended through the aperture 3245 and therefore helps to secure the upper 38 to the device 3310 via the tab 3249. The tab 3249 is thus anchored to the center segment 16 by the pin 3283.

Figure 36:
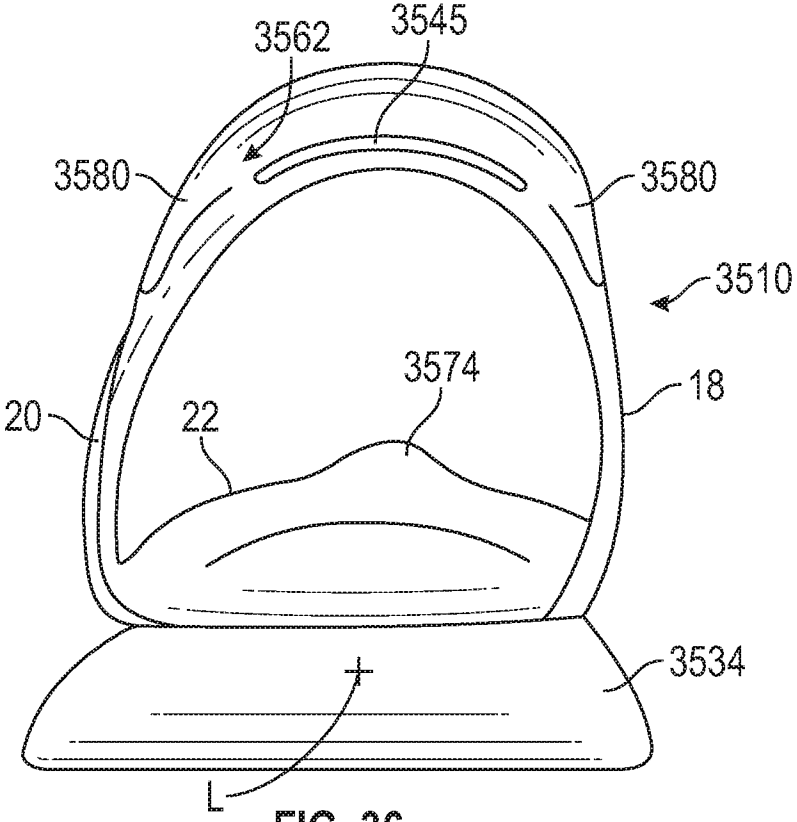
FIG. 36 is a schematic illustration in front view of the heel spring device of FIG. 35 in an unloaded position on a sole structure of the article of footwear with the upper not shown.
Figure 37:
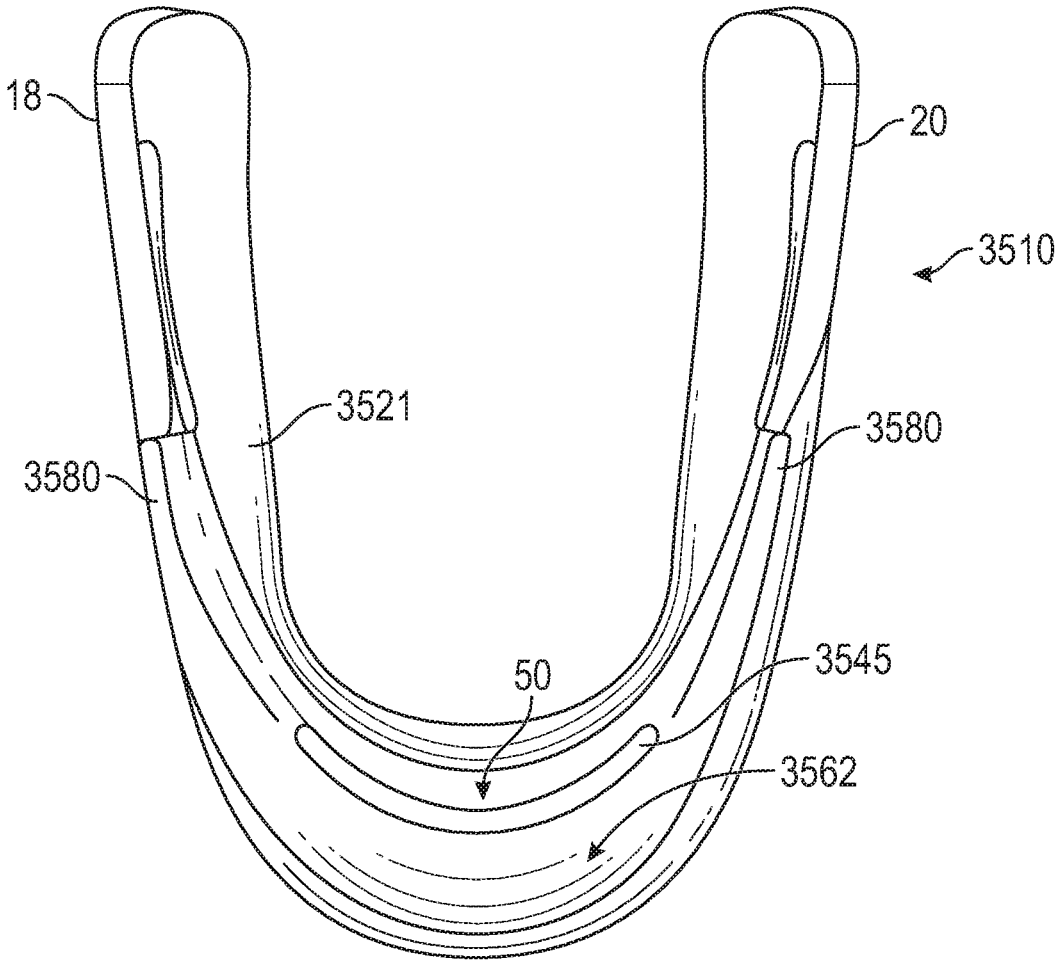
FIG. 37 is a schematic illustration in plan view of the heel spring device of the article of footwear of FIG. 30.

FIGS. 30-35 illustrate another embodiment of an article of footwear 3512 with a heel spring device 3510 that has many of the same functions and features as any of the other heel spring devices shown and described herein, such as but not limited to heel spring devices 10, 3210, and 3310, which features are referenced with like reference numbers. The device 3510 is also shown in FIGS. 36 and 37.

Figure 30:
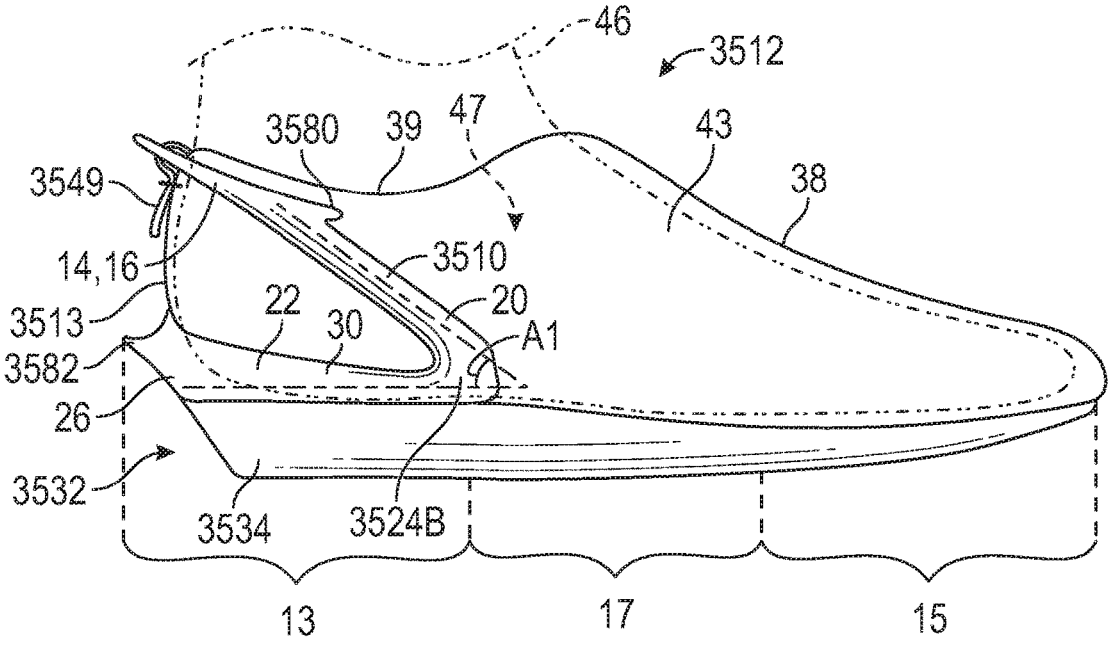
FIG. 30 is a schematic illustration in lateral side view of an article of footwear with an alternative embodiment of a heel spring device in an unloaded position and with a foot in phantom and in fragmentary view.

The device 3510 is configured to surround a portion of a foot-receiving cavity 47 formed by the upper 38 at the heel region 13 of the article of footwear 3512. The heel spring device 3510 is connected to and surrounds the heel region 13 of the upper 38. The article of footwear 3512 includes a sole structure 3532 secured to and underlying the upper 38. As shown, the sole structure 3532 includes one or more sole components that may be sole layers 3534, such as an outsole, a midsole, or a unitary combination of an outsole and a midsole that may be referred to as a unisole. In FIG. 30, the sole layer 3534 shown may be a midsole with an outsole (not shown), or may be a unisole. The sole layer 3534 underlies the upper 38. The lower portion of the footwear upper 38 is secured to the sole layer 3534, such as by adhesive or otherwise.

The device 3510 includes a control bar 14 having a center segment 16, a medial side arm 18 extending downwardly and forwardly from the center segment 16 along the medial side 41 of the upper 38, and a lateral side arm 20 spaced from the medial side arm 18 and extending downwardly and forwardly along the lateral side 43 of the upper 38 from the center segment 16. The center segment 16, the medial side arm 18, and the lateral side arm 20 may be portions of an integral, one-piece component as in the embodiment shown, or may be separate components attached to one another.

In one or more embodiments, such as is in the embodiment shown, the device 3510 includes a continuous base 22 connected to both the medial side arm 18 and the lateral side arm 20. Similar to device 10, the continuous base 22 is connected to both a forward extent of the medial side arm 18 and a forward extent of the lateral side arm 20 and extends rearwardly therefrom under the control bar 14 around a rear of the heel region 13 of the upper 38. In one or more embodiments of the article of footwear 3512, the device 3510 need not include a base, and ends of the medial side arm 18 and the lateral side arm 20 opposite the center segment 16 are anchored, such as to the sole structure 3532. In such embodiments, for example, rather than extending from a center segment of a base, the extension may be a secured to the upper 38 or to the sole structure 3532 in the back portion 3513 of the article of footwear 3512, such as in a rear-facing portion of the heel region 13.

Figure 35:
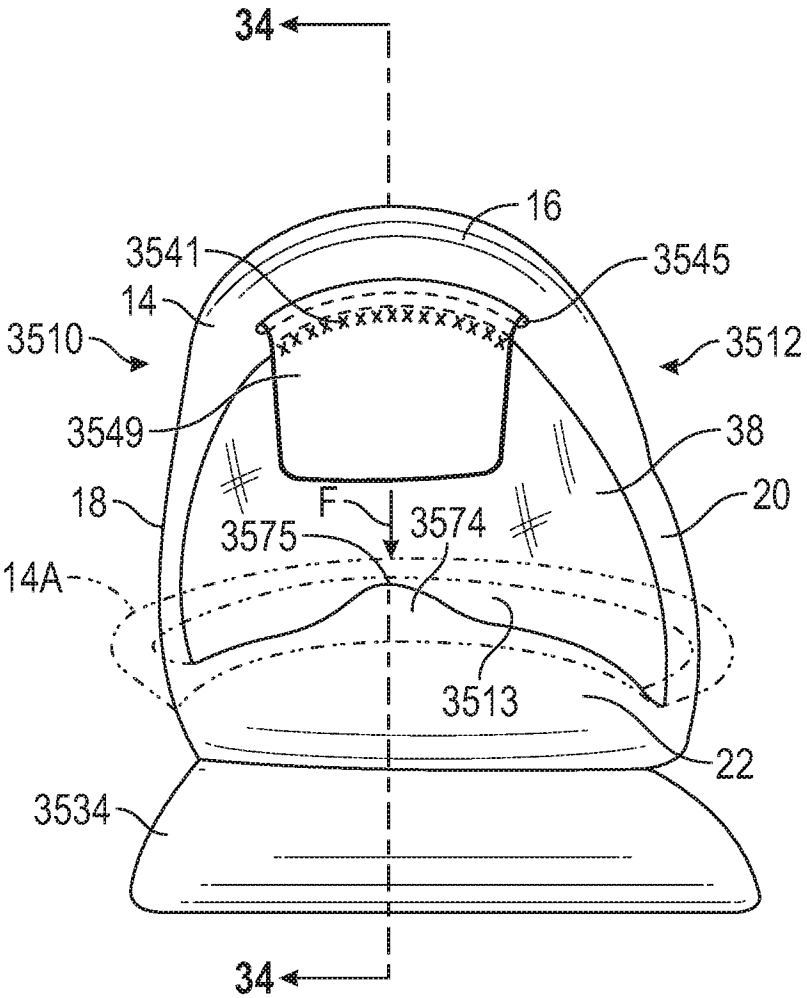
FIG. 35 is a schematic illustration in rear view of the article of footwear of FIG. 30 with the heel spring device in an unloaded position and showing a loaded position in phantom.

The base 22 has a medial base arm 28 connected to the medial side arm 18 of the control bar 14, a lateral base arm 30 connected to the lateral side arm 20 of the control bar 14, and a center segment 26 connecting the medial base arm 28 to the lateral base arm 30. In one example, the control bar 14 has an arced shape, and the continuous base 22 has an arced shape as indicated by FIGS. 35-37, and the control bar 14 and the base 22 are configured as a full elliptical leaf spring. The control bar 14 and the base 22 are not limited to the arced shapes shown, and may have other shapes within the scope of the disclosure. In the embodiment shown, the base 22 is continuous and extends between and connects to the first side arm 18 and the second side arm 20. The base 22 is continuous in that it is without breaks or connections through other components in extending from the first side arm 18 to the second side arm 20. The center segment 26, the first base arm 28, and the second base arm 30 are all disposed in a common plane, as described with respect to the device 10 of FIG. 3.

The base 22 may be secured to the sole layer 3534 such as by bonding with adhesive, thermal bonding, or otherwise. The continuous base 22 is mounted on the sole structure 3532. For example, similar to the device 3310, the base 22 has an inwardly-extending flange 3521, shown in FIG. 37, that extends continuously from the medial base side arm 28, around the center segment 26 to the lateral base side arm 30 such that the flange 3521 generally has a U-shape. The sole layer 3534 has a recess similar to recess 3349 of FIG. 26 in which the flange 3521 nests. The heel spring device 3510 is secured to the sole layer 3534 by securing the flange 3521 to upper surface of the sole layer 3534 in the recess by thermal bonding, by adhesive, or otherwise.

Additionally, the base 22 may be secured to a lower portion of the upper 38 with which it is in contact. The control bar 14 is also secured to the upper 38 as the center segment 16 is connected to the upper 38 rearward of the ankle opening 39 of the upper 38. As best shown in FIGS. 35 and 36, the center segment 16 of the control arm 14 has an aperture 3545 that may be configured as a curved slot as shown, and that extends through the center segment 16. The article of footwear 3512 has a tab 3549 extending from the heel region 13 of the upper 38 at the back portion 3513 of the upper 38, through the aperture 3545. The tab 3549 is secured to the heel region 13 of the upper 38 adjacent to the control bar 14 to connect the upper 38 to the control bar 14. In the embodiment shown, the tab 3549 is secured to the upper 38 by box stitching 3541, shown in FIG. 35, immediately below the aperture 3545 to minimize the slack (i.e., the lost motion) of the control bar 14 relative to the upper 38 when the control bar 14 is depressed by an applied force F, shown in FIG. 32 with the depressed position of the control bar 14 indicated as 14A. Although shown as stitched with a box stitch, other types of stitches, or other modes of securing the tab 3549 to the upper 38 may be utilized, such as by use of a rivet through the tab 3549 and the upper 38, adhesive, or otherwise.

The medial side arm 18 and the lateral side arm 20 extend downwardly and forwardly from the center segment 16 of the control bar 14 to define an acute angle A1 (referred to as a first acute angle or as a first angle) with the continuous base 22 when in the unloaded position of FIG. 30. The area at which the base arms 28, 30 of the base 22 connect to the side arms 18, 20 of the control bar 14 may be referred to as junctions 3524A, 3524B or joints. The control bar 14 has an arced shape from the first joint 3524A to the second joint 3524B. Similarly, the base 22 has an arced shape from the first joint 3524A to the second joint 3524B. With this arrangement, the control bar 14 and the base 22 are configured as a full elliptical leaf spring as described herein. Additionally, the device 3510 may be a single, unitary, one-piece component as shown. For example, the device 3510 may be injection molded as a single, unitary, one-piece component.

Figure 32:
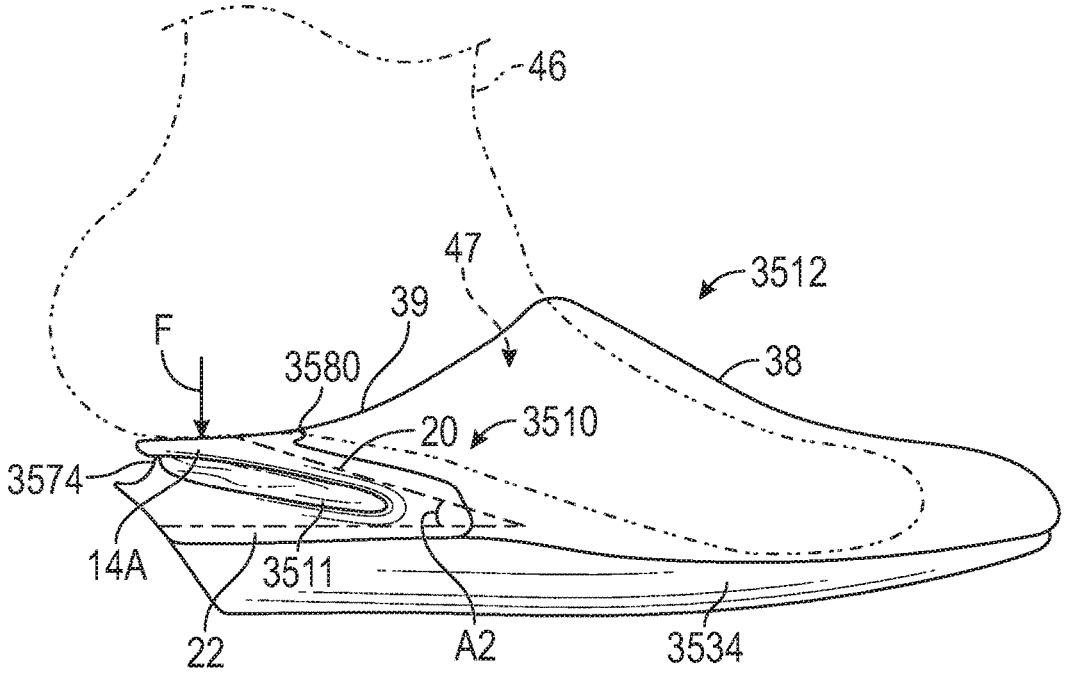
FIG. 32 is a schematic illustration in lateral side view of the article of footwear of FIG. 30 with the foot in phantom placing the heel spring device in a loaded position.

At least a portion of the control bar 14 is elastically deformable under an applied downward force F depressing the control bar 14 toward the continuous base 22, as shown in FIG. 32, in which the medial side arm 18 and the lateral side arm 20 define a second acute angle A2 with the continuous base 22 when in the loaded position. As best shown in FIGS. 32 and 35, the medial side arm 18 and the lateral side arm 20 of the control bar 14 are elastically deformable under the applied force F depressing the control bar 14 toward the continuous base 22. In FIG. 32, the foot 46 provides the downward force F on the control bar 14, which moves the ankle opening 39 closer to the sole structure 3532 at the heel region 13, enabling the foot 46 to slide forward and downward into the foot-receiving cavity 47 from the rear. The control bar 14 then returns to the unloaded position following removal of the applied load (i.e., after the foot 46 has slid forward of the center segment 16, as shown in FIG. 30). The device 3510 may be referred to as a heel spring due to its ability to elastically deform under an applied downward force F, and then return to the unloaded position when the force is removed. The upper 38 moves with the center segment 16 due to their connection via the tab 3549 through the aperture 3545. The upper 38 deforms toward the foot-receiving cavity 47 at the rear of the heel region 13 as discussed with respect to FIG. 34 when the control bar 14 is depressed such that the ankle opening 39 of the foot-receiving cavity 47 is closer to the sole structure 3532 when the control bar 14 is depressed by the applied force F than when the applied force F of the foot 46 is removed.

Figure 34:
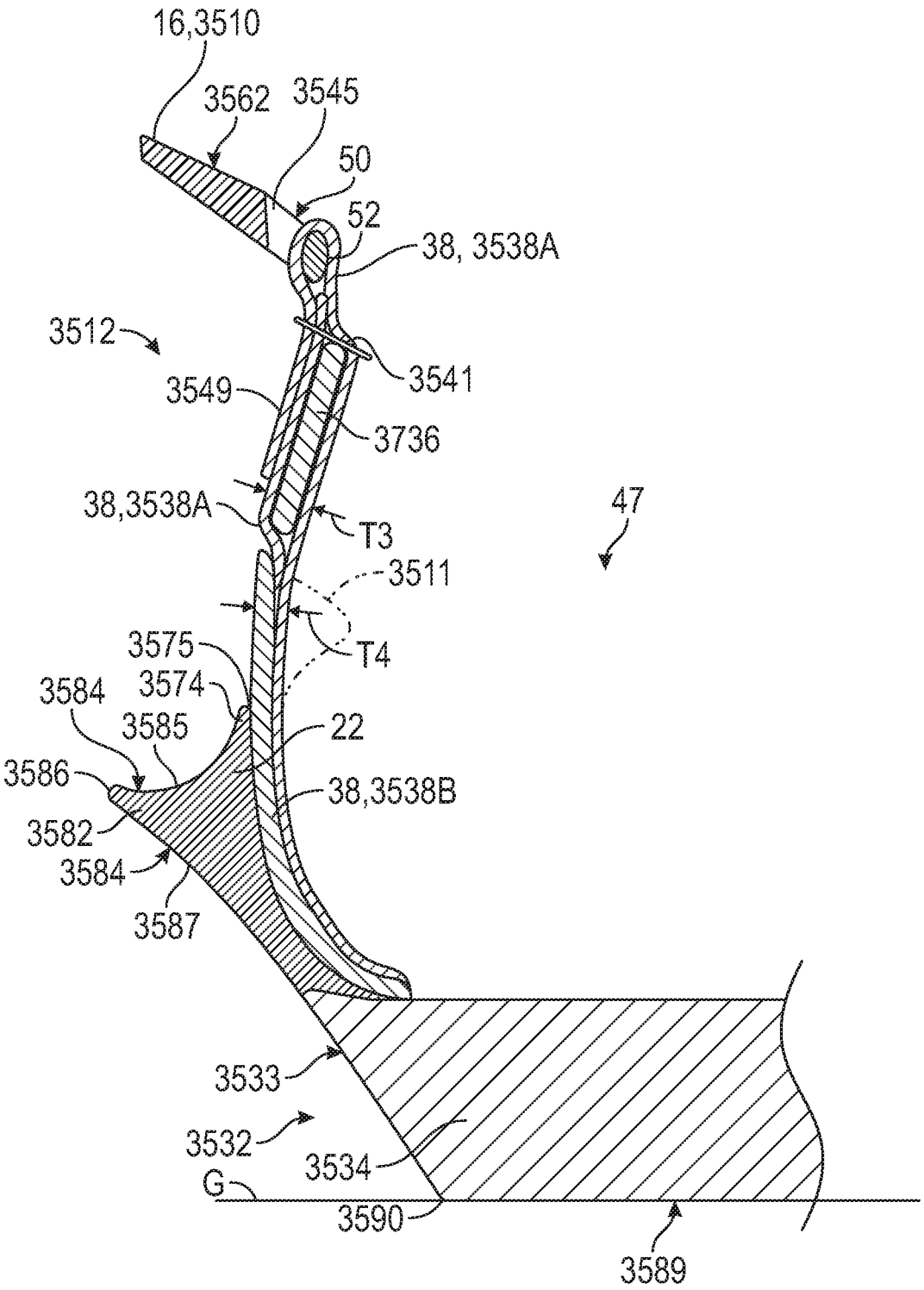
FIG. 34 is a schematic illustration in fragmentary cross-sectional view of the article of footwear of FIG. 35 taken at lines 34-34 in FIG. 35.

The continuous base 22 includes an extension 3574 disposed on the center segment 26 of the base 22, centrally disposed at the back portion 3513 of the upper 38, and extending upwardly toward the control bar 14 as best shown in FIGS. 34 and 35. The extension 3574 limits downward movement of the control bar 14 toward or past the continuous base 22. Stated differently, and as best shown in FIG. 32, the control bar 14 (indicated at position 14A in FIG. 32) will contact the extension 3574 if depressed downward to form the second acute angle A2 with the continuous base 22. The extension 3574 is configured to limit the downward movement of the control bar 14 to the maximum depressed position shown in FIG. 32. The extension 3574 is configured so that, at the maximum depressed position of FIG. 32 (i.e., with the heel spring device 3510 at the second acute angle A2), the heel spring device 3510 is still within the elastic deformation range. In other words, the extension 3574 prevents or at least reduces over-bending of the control bar 14 which could cause plastic deformation of the heel spring device 3510. Because plastic deformation could eventually cause rupture of the device 3510 due to failure of the material of the device over time, by preventing plastic deformation, the extension 3574 may prolong the useful life of the device 3510.

The extension 3574 is shown as a single rounded protrusion extending upwardly from the center segment 26 of the base 22, but is not limited to this shape. The extension 3574 is generally centrally disposed on the center segment 26 and tapers in width in the transverse direction of the footwear 3512, as shown in FIG. 35. The extension 3574 also tapers in width from the base 22 to a tip 3575 of the extension 3574, as shown in FIG. 34. The tapered configuration of the extension 3574 and its central location at the back portion 3513 of the heel region 13 causes the force of the extension 3574 against the deforming upper 38 to be concentrated at the tip 3575 of the extension 3574 when the control bar 14 is sufficiently depressed. The temporary deformation and/or folding of the upper 38 is indicated at folds 3511 in FIG. 32. The extension 3574 is stiffer than at least some of the material of the upper 38 in the heel region 13, which may assist in causing the upper 38 to temporarily deform or fold in a somewhat symmetrical manner, generally evenly distributed on either side of the extension 3574 (i.e., toward the medial side 41 and toward the lateral side 43). Deformation of the upper 38 is further discussed herein with respect to FIG. 34.

As best shown in FIGS. 30, 31, 36 and 37, at either or both of the medial side 41 and the lateral side 43 of the control bar 14, the upper surface 3562 of the center segment 16 may extend along a ledge 3580 projecting forwardly above a descending portion of a corresponding one of the medial side arm 18 and lateral side arm 20. In the embodiment shown, the upper surface 3562 extends such that the ledge 3580 is disposed along descending portions of both the medial side arm 18 and the lateral side arm 20. Stated differently, the device 3510 has a raised ledge 3580 extending from an upper surface 3562 of the center segment 16 of the control bar 14 partway down the medial side arm 18 and partway down the lateral aide arm 20. The ledge 3580 may be adapted to be depressed by a user's foot, and may provide a support structure for the foot 46 to rest on and press downward against when inserting the foot 46 into the foot-receiving cavity 47, as indicated in FIG. 32. The ledge 3580 may help wearers who have limited dexterity or accuracy of foot placement as it may enable depression of the control bar 14 to occur even when the heel of the foot 46 is not precisely centered on the control bar 14.

An upper surface 3562 of the center segment 16 of the control bar 14 slopes forwardly and downwardly, as best shown in the cross-sectional view of FIG. 34. As described with respect to the heel spring device 10, to further ease entry of the foot 46 into the foot-receiving cavity 47 of the upper 38, the center segment 16 of the control bar 14 has a ramped surface 50 that declines toward an inner periphery 52 of the center segment 16, as indicated in FIG. 34. There is a slight change in slope of the center segment 16 between the upper surface 3562 and the ramped surface 50. The ramped surface 50 has a steeper declining slope than the upper surface 3562, helping the rear of the foot 46 to slide downward and forward, in the direction of the ankle opening 39 and into the foot-receiving cavity 47. At least a portion of the device 3510 may comprise a material having certain properties, such as a relatively low coefficient of friction to encourage the foot 46 to slide downward and forward in this manner. For example, at least a portion of the device 3510, such as the upper surface of the control bar 14 including upper surface 3562, may include a material with a lower coefficient of friction than the material or materials of the upper 38. For example, at least a portion of the device 3510 may include a coating having these properties. In one example, at least a portion of the device 3510 may comprise a polyether block amide. For example, the device 3510 may be, but is not limited to, a polyether block amide such as PEBAX® 72r53 available from Arkema, Inc. in King of Prussia, Pa. USA. If at least a portion of the device 3520 comprises a material with a relatively low coefficient of friction, this may ease foot entry whether the foot 46 is bare or a sock is disposed on the foot 46, as both bare skin or any of various sock materials may slide with greater ease downward and forward into the foot-receiving cavity 47 when sliding against the at least a portion of the control bar 14 that includes a material with a relatively low coefficient of friction.

As best shown in FIG. 34, the upper 38 has a first thickness T3 at a first location between the control bar 14 and the extension 3574, and a second thickness T4 less than the first thickness T3 at a second location between the first location and the extension 3574 (i.e., the thinner second location nearer to the extension 3574 than the thicker first location). For example, the upper 38 may include layers of a first material 3538A adjacent to the control bar 14, with an insert 3736 between the layers of first material 3538A. The upper 38 may include an additional layer of a second material 3538B adjacent to the extension 3574. Additionally, the first material 3538A may be a flexible nylon, and the second material 3538B may be a thicker, and somewhat stiffer suede. The insert 3736 may be stiffer than the first material 3538A and the second material 3538B. With the insert 3736, the overall thickness and/or stiffness of the upper 38 at the first location is greater than at the second location. With the tip 3575 of the extension 3574 concentrating forces against the upper 38, the upper 38 will tend to begin to deform toward the foot-receiving cavity 47 at the thinner second location when the control bar 14 is moved toward the extension 3574, as indicated by the phantom line 3511 showing a fold of the upper 38. Additionally, the upper 38 has no heel counter in the heel region 13 of the heel spring device 3510. The upper 38 and the device 3510 will stop deforming at the maximum depressed position of the control bar shown at 14A in FIG. 32. When the downward applied force F is removed, the folded upper 38 returns to the original unfolded position of FIGS. 30 and 34 as the biased heel spring device 3510 returns to the unloaded position. The connection of the upper 38 to the control bar 14 by the tab 3549 pulls the upper 38 along with the control bar 14 to the original, unloaded position.

Figure 31:
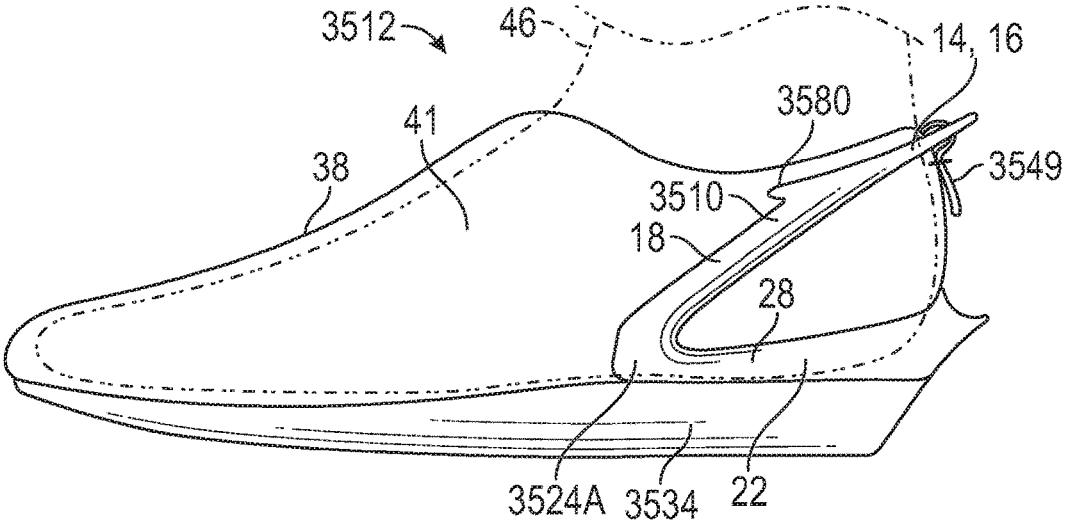
FIG. 31 is a schematic illustration in medial side view of the article of footwear of FIG. 30.
Figure 33:
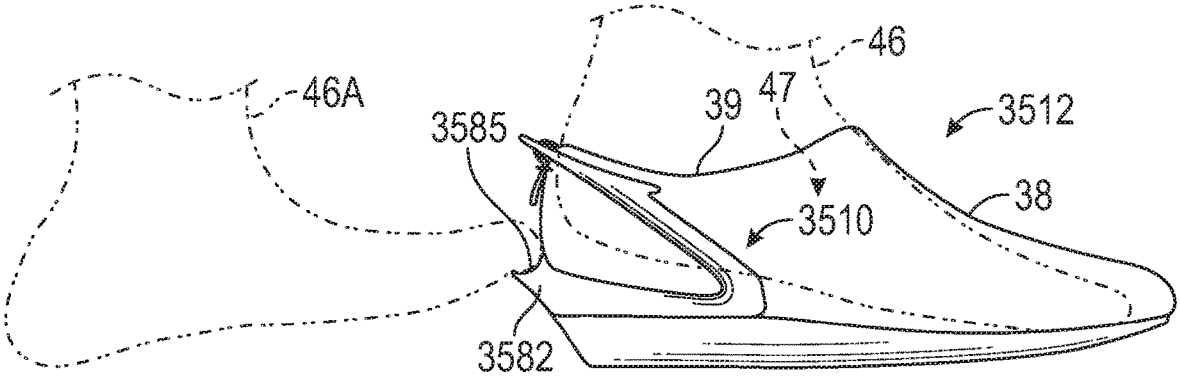
FIG. 33 is a schematic illustration in lateral side view of the article of footwear of FIG. 30 with a left foot in phantom holding a rear protrusion of the heel spring device and a right foot in phantom withdrawing from the article of footwear.

As shown in FIGS. 30 and 31, the center segment 26 of the base 22 has a rear protrusion 3582 extending away from the medial base arm 28 and the lateral base arm 30 (i.e., generally rearward). The extension 3574 may be considered to include the portion extending upward to the tip 3575 and the rear protrusion 3582. With reference to FIG. 34, the rear protrusion 3582 has a beveled outer surface 3584 with a concave upper bevel 3585 extending forwardly from a rearmost extent 3586 of the rear protrusion 3582, and a lower bevel 3587 that slopes downwardly and forwardly from the rearmost extent 3586 of the rear protrusion 3582. As best shown in FIG. 33, the wearer may rest their opposite foot 46A (e.g., the left foot as shown) on the concave upper bevel 3585 to hold the rear of the footwear 3512 down as the foot 46 (e.g., the right foot as shown) is removed from the foot-receiving cavity 47 of the upper 38 by withdrawing the foot 46 through the ankle opening 39. The rear protrusion 3582 is configured to protrude sufficiently far to enable the edge of the opposite foot 46A, or the toes of the opposite foot to rest on the concave upper bevel 3585. The beveled outer surface 3584 at the concave upper bevel 3585 may provide more surface area in contact with the holding foot 46A than would a planar bevel, as portions of the surface of the holding foot 46A are also generally rounded and may better conform to the beveled outer surface 3584 of the concave upper bevel 3585.

As best shown in FIG. 34, the sole layer 3534 has a rear surface 3533 that slopes downwardly and forwardly from the lower bevel 3587 of the beveled outer surface 3584 at the same or substantially the same slope as the lower bevel 3587. The continuous slope of the lower bevel 3587 and the surface 3533 of the sole layer 3534 moves the ground contact surface 3589 of the sole layer 3534 (shown resting on level ground G) slightly forward of the center segment 26 and the rear protrusion 3582. This may encourage forces applied by the holding foot 46A on the concave upper bevel 3585 of the rear protrusion 3582 to provide a counterclockwise torque about the back edge 3590 of the sole layer 3534 in contact with the ground G, counteracting the forces that the foot 46 being withdrawn may place when pressing upward against the upper 38 forward of the ankle opening 39 as the foot 46 is withdrawn.

As is evident in FIGS. 35 and 36, the heel spring device 3510 is asymmetric relative to the longitudinal axis L of the article of footwear 3512. The longitudinal axis L extends into the page in FIG. 36, and is disposed in the same manner as shown with respect to the embodiment of FIG. 27. The asymmetric shape may be similar to the anatomical shape of a heel to avoid undue friction and pressure against the sides of the foot 46 during wear. For example, the medial side arm 18 may be of a different length and/or curvature than that of the lateral side arm 20, similar to the shape of a typical heel region of a foot.

The various embodiments of heel spring devices disclosed herein enhance the ease of foot entry, allowing hands free foot entry into an article of footwear.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear" or "footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, unless stated otherwise, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of an article of footwear extends between a forefoot region and a heel region of the article of footwear. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of an article of footwear extends between a lateral side and a medial side of the article of footwear. The transverse direction or axis may also be referred to as a lateral direction or axis or a mediolateral direction or axis.

The term "vertical" refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the article of footwear is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the article of footwear in an assembled article of footwear. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. For example, shapes shown in the drawings and/or described in the specification, are exemplary and not limiting, and the features may have alternative shapes. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

The invention claimed is:

1. An article of footwear comprising:

an upper defining a foot-receiving cavity with an ankle opening;

a device connected to a heel region of the upper and including:

a control bar having a center segment connected to the upper rearward of the ankle opening, a medial side arm extending downwardly and forwardly from the center segment at a medial side of the upper, and a lateral side arm extending downwardly and forwardly from the center segment at a lateral side of the upper;

an extension disposed at a back portion of the article of footwear and having a tip extending upwardly toward the control bar;

wherein the upper has a first stiffness at a first location between the control bar and the extension, a second stiffness at a second location between the first location and the extension, and the second stiffness is less than the first stiffness;

wherein at least a portion of the control bar is elastically deformable under an applied downward force depressing the control bar toward the extension, the tip of the extension deforming the upper inward toward the foot-receiving cavity at the second location; and wherein the control bar and the upper return to an unloaded position upon removal of the applied downward force.

2. The article of footwear of claim 1, wherein:

the upper has a first thickness at the first location, a second thickness at the second location, and the second thickness is less than the first thickness.

3. The article of footwear of claim 1, wherein the extension is centrally disposed at the back portion of the article of footwear.

4. The article of footwear of claim 1, wherein the upper includes:

multiple layers of a first material at the first location; and an insert disposed between the layers of the first material.

5. The article of footwear of claim 4, wherein the upper includes:

an additional layer of a second material at the second location.

6. The article of footwear of claim 5, wherein the insert is stiffer than the first material and the second material.

7. The article of footwear of claim 5, wherein the multiple layers extend between the first location and the second location, below the insert and above the second material.

8. The article of footwear of claim 7, wherein a portion of the upper below the insert and above the second material consists of only the multiple layers.

9. The article of footwear of claim 5, wherein one of the layers of the first material extends from the first location to the second location.

10. The article of footwear of claim 5, wherein the first material is a flexible nylon, and the second material is suede.

11. The article of footwear of claim 10, wherein at least a portion of the device comprises a polyether block amide.

12. The article of footwear of claim 1, further comprising:

a base having a medial base arm connected to the medial side arm of the control bar, a lateral base arm connected to the lateral side arm of the control bar, and a center segment connecting the medial base arm to the lateral base arm; and the extension is disposed on the center segment of the base and extends away from the medial base arm and the lateral base arm.

13. The article of footwear of claim 1, wherein the center segment of the control bar includes an aperture; and the article of footwear further comprising:

a tab extending from the heel region of the upper through the aperture and secured to the heel region of the upper adjacent to the control bar to connect the upper to the control bar.

14. The article of footwear of claim 1, wherein the extension has a rear protrusion that has a beveled outer surface with a concave upper bevel extending forwardly from a rearmost extent of the rear protrusion, and with a lower bevel that slopes downwardly and forwardly from the rearmost extent of the rear protrusion.

15. The article of footwear of claim 1, further comprising:

a base connected to both the medial side arm and the lateral side arm; wherein the extension extends from the base.

16. The article of footwear of claim 15, wherein the medial side arm and the lateral side arm extend downwardly and forwardly from the center segment of the control bar to define an acute angle with the base when in the unloaded position.

17. The article of footwear of claim 16, wherein:

the base has a medial base arm connected to the medial side arm of the control bar, a lateral base arm connected to the lateral side arm of the control bar, and a center segment connecting the medial base arm to the lateral base arm; and the extension is a rounded protrusion extending upwardly to the tip from the center segment of the base.

18. The article of footwear of claim 16, wherein:

the base has a medial base arm connected to the medial side arm of the control bar, a lateral base arm connected to the lateral side arm of the control bar, and a center segment connecting the medial base arm to the lateral base arm; and the center segment of the base has a rear protrusion extending away from the medial base arm and the lateral base arm.

19. The article of footwear of claim 1, wherein an upper surface of the center segment of the control bar slopes forwardly and downwardly.

20. The article of footwear of claim 1, wherein at either or both of a medial side and a lateral side of the control bar, an upper surface of the center segment extends along a ledge projecting forwardly above a descending portion of a corresponding one of the medial side arm and lateral side arm.

* * * * *